US010907784B2

(12) United States Patent
Chien

(10) Patent No.: US 10,907,784 B2
(45) **Date of Patent: *Feb. 2, 2021**

(54) MULTIPLE FUNCTIONS LED NIGHT LIGHT

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/285,631

(22) Filed: Feb. 26, 2019

(65) Prior Publication Data

US 2019/0195445 A1 Jun. 27, 2019

Related U.S. Application Data

(63) Continuation-in-part of application No. 16/242,761, filed on Jan. 8, 2019, and a continuation of application No. 14/739,397, filed on Jun. 15, 2015, now Pat. No. 10,184,624, said application No. 16/242,761 is a continuation of application No. 14/739,397, filed on Jun. 15, 2015, now Pat. No.

(Continued)

(51) Int. Cl.

| | |
|---|---|
| ***F21S 8/00*** | (2006.01) |
| ***F21V 5/04*** | (2006.01) |
| ***F21V 15/01*** | (2006.01) |
| ***F21V 33/00*** | (2006.01) |
| ***F21V 23/06*** | (2006.01) |
| ***F21S 9/02*** | (2006.01) |
| ***F21K 9/232*** | (2016.01) |
| ***F21K 9/60*** | (2016.01) |
| ***F21Y 115/10*** | (2016.01) |
| ***F21Y 113/13*** | (2016.01) |
| ***F21V 23/02*** | (2006.01) |
| ***F21V 23/04*** | (2006.01) |
| ***H01R 24/76*** | (2011.01) |
| ***H01R 33/92*** | (2006.01) |
| *H01R 103/00* | (2006.01) |

(52) U.S. Cl.

CPC ..... *F21S 8/035* (2013.01); *F21V 5/04* (2013.01); *F21V 15/01* (2013.01); *H01R 33/92* (2013.01); *F21K 9/232* (2016.08); *F21K 9/60* (2016.08); *F21S 9/022* (2013.01); *F21V 23/02* (2013.01); *F21V 23/04* (2013.01); *F21V 23/06* (2013.01); *F21V 33/0052* (2013.01); *F21Y 2113/13* (2016.08); *F21Y 2115/10* (2016.08); *H01R 24/76* (2013.01); *H01R 2103/00* (2013.01)

(58) Field of Classification Search

CPC ..... F21S 8/035; F21V 5/04

See application file for complete search history.

(56) References Cited

U.S. PATENT DOCUMENTS 2,227,549 A * 1/1941 McNeill ..... H01R 13/631 200/310

3,056,897 A * 10/1962 Knochel ..... H05B 33/06 313/483

(Continued)

*Primary Examiner* — William N Harris

(74) *Attorney, Agent, or Firm* — Bacon & Thomas, PLLC

(57) ABSTRACT

A multiple function LED night light not only offers LED illumination with predetermined colors, functions, or effects, but also includes additional functions such as providing a power source, sensor(s), power fail functions, and wireless control functions. Lighting effects may also be achieved through the use of multiple optic or protective lenses that cause multiple reflections and/or refraction of light beams emitted by one or more single or multiple color LEDs.

35 Claims, 8 Drawing Sheets

Related U.S. Application Data

10,184,624, which is a continuation of application No. 11/806,285, filed on May 31, 2007, application No. 16/285,631, which is a continuation-in-part of application No. 11/498,874, filed on Aug. 4, 2006, which is a continuation of application No. 10/954, 189, filed on Oct. 1, 2004, now abandoned.

(56) References Cited

U.S. PATENT DOCUMENTS 3,924,914 A 12/1975 Banner
3,974,495 A 8/1976 Jones
4,000,405 A 12/1976 Horwinski
4,177,500 A * 12/1979 Nicholl ..... F21S 9/022 315/86
4,343,032 A * 8/1982 Schwartz ..... F21V 23/0442 362/276
4,816,973 A 3/1989 Atalla et al.
4,992,704 A * 2/1991 Stinson ..... H05B 45/20 315/312
5,465,198 A 11/1995 Kellogg
5,544,025 A 8/1996 Bohlool
5,662,408 A * 9/1997 Marischen ..... F21S 8/035 362/253
5,664,867 A 9/1997 Martin
5,727,953 A 3/1998 Pasholk
5,924,784 A 7/1999 Chliwnyj et al.
5,926,440 A 7/1999 Chien
5,964,516 A * 10/1999 Lai ..... F21S 8/035 362/641
6,158,868 A * 12/2000 Chien ..... F21V 33/0076 362/253
6,220,722 B1 4/2001 Begemann
6,390,647 B1 * 5/2002 Shaefer ..... F21S 8/035 362/276
6,431,719 B1 * 8/2002 Lau ..... F21V 23/0442 362/95
6,478,440 B1 11/2002 Jaworski et al.
6,499,853 B2 12/2002 Stekelenburg
6,499,860 B2 12/2002 Begemann
6,577,073 B2 6/2003 Shimizu et al.
6,648,496 B1 11/2003 Elghoroury et al.
6,709,126 B1 3/2004 Leen
6,762,563 B2 7/2004 St-Germain et al.
6,905,231 B2 6/2005 Dickie
6,911,915 B2 6/2005 Wu et al.
6,926,426 B2 8/2005 Currie et al.
6,953,264 B2 10/2005 Ter-Hovhannisian
6,964,498 B2 11/2005 Wu
7,006,002 B2 2/2006 Shomali
7,025,473 B2 4/2006 Dokoupil
7,036,948 B1 5/2006 Wyatt
7,045,975 B2 5/2006 Evans
7,186,016 B2 3/2007 Jao
7,355,349 B2 4/2008 Evans
7,524,089 B2 4/2009 Park
7,909,477 B2 3/2011 Chien
2003/0185020 A1 10/2003 Stekelenburg
2004/0246704 A1 12/2004 Burdick
2006/0007709 A1 1/2006 Yuen
2006/0072346 A1 4/2006 Chien
2006/0146527 A1 7/2006 Vanderschuit
2008/0074873 A1 * 3/2008 Lin ..... F21S 8/035 362/235
2008/0224637 A1 * 9/2008 Parker ..... F21S 8/035 315/309
2008/0233780 A1 * 9/2008 Waters ..... H01R 13/7172 439/214
2009/0225568 A1 * 9/2009 Spartano ..... F21S 8/035 362/641
2010/0290254 A1 * 11/2010 Howard ..... F21S 8/035 362/641
2011/0110118 A1 * 5/2011 Hsiao ..... A61L 9/03 362/643
2013/0176738 A1 * 7/2013 Tinaphong ..... F21V 33/00 362/253
2013/0265743 A1 * 10/2013 Lee ..... F21V 33/0004 362/96
2014/0028210 A1 * 1/2014 Maxik ..... F21V 23/06 315/200 R
2014/0185325 A1 * 7/2014 Howard ..... F21S 8/035 362/641
2016/0047525 A1 * 2/2016 Wang ..... F21V 5/04 362/311.06

* cited by examiner

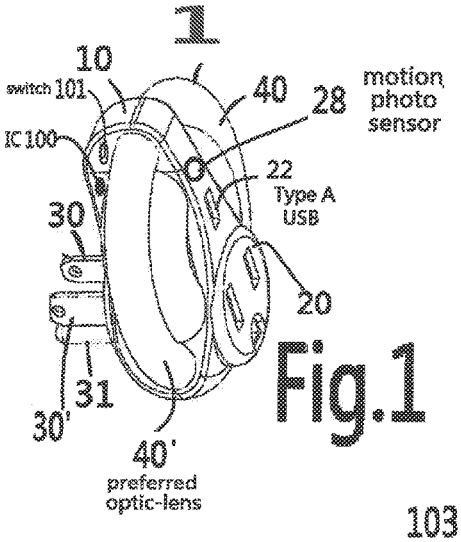
Fig.1
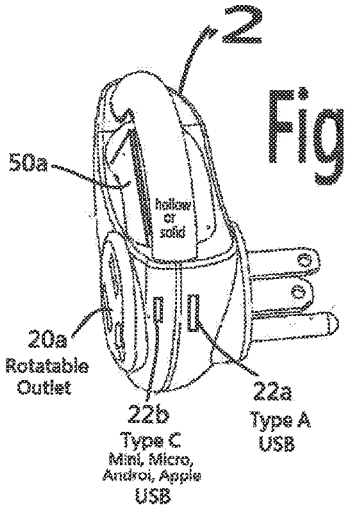
Fig. 2
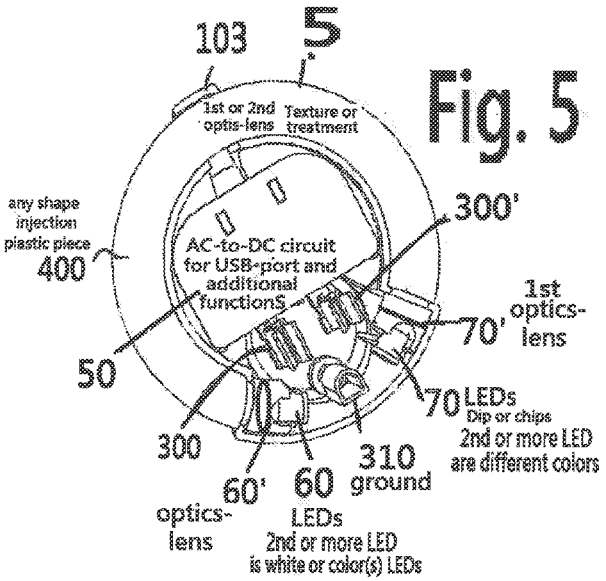
Fig. 5
Fig. 3
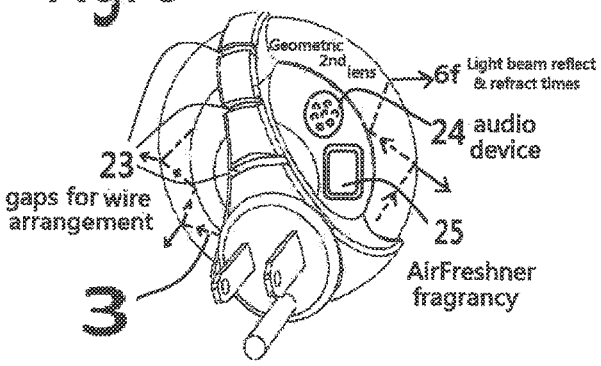
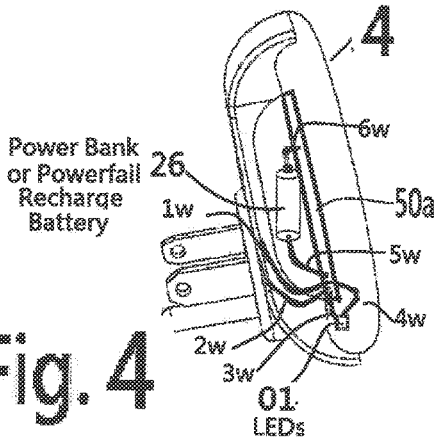
Fig. 4

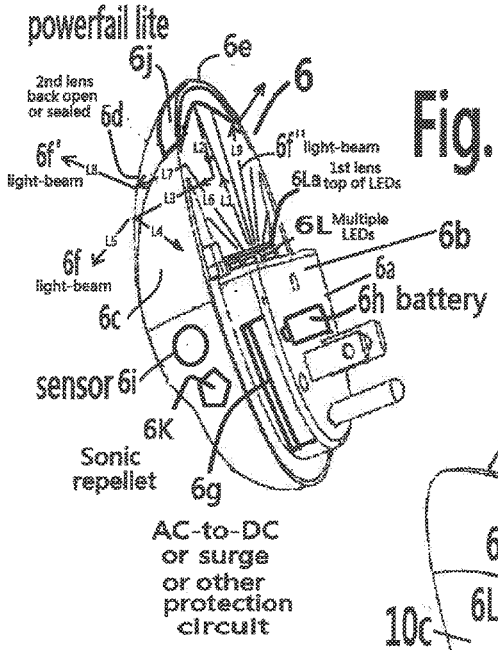
Fig. 6
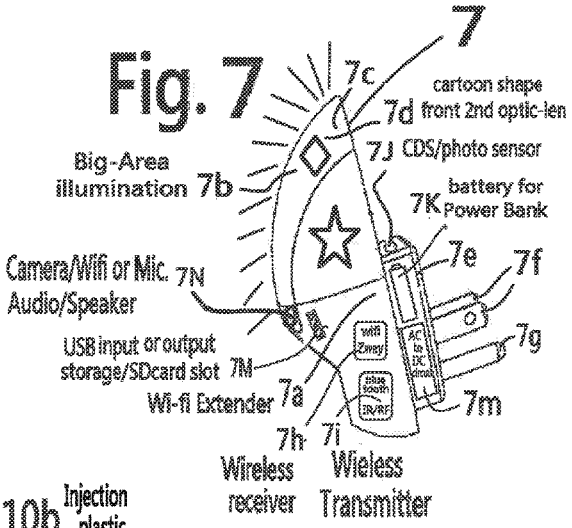
Fig. 7
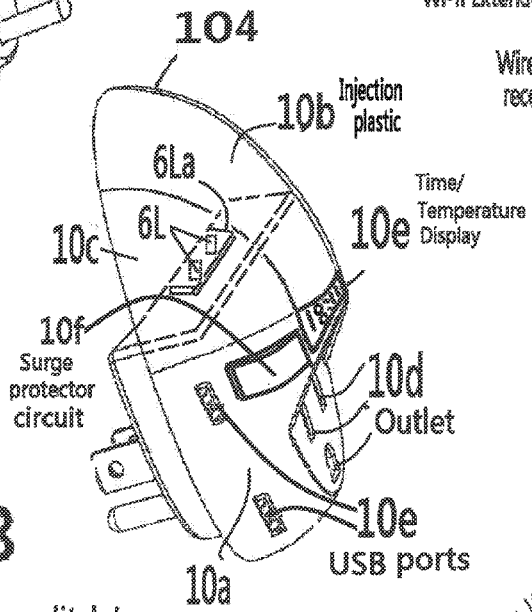
Fig. 10
Fig. 8
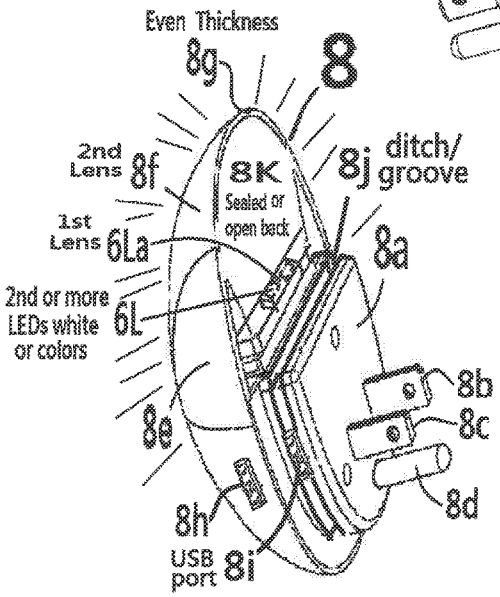
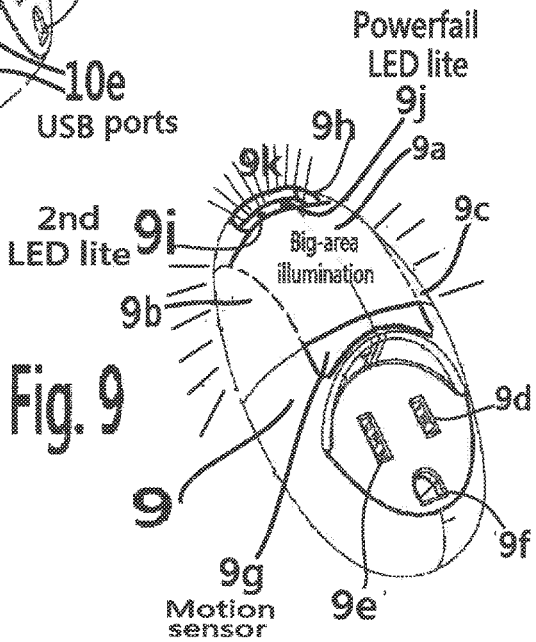
Fig. 9

Different with Parent Filed 6,227,679 5/8-2001

12 Any geometric shape injection cover or Character shape

2nd or more additional function(s) circuit(s), Trigger-system(s), IC(s), wireless controller, communication(s)

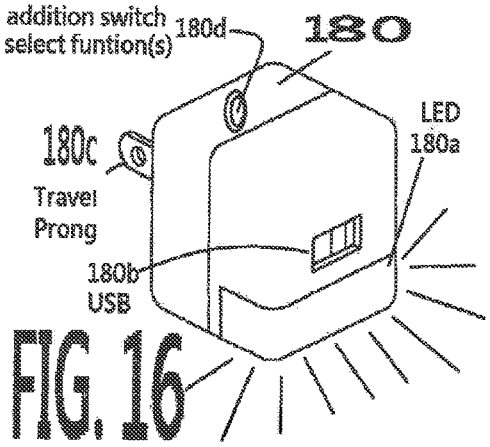
FIG. 16
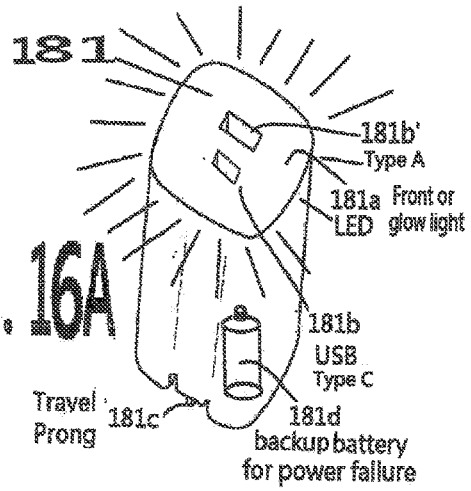
Fig. 16A
Fig. 16B
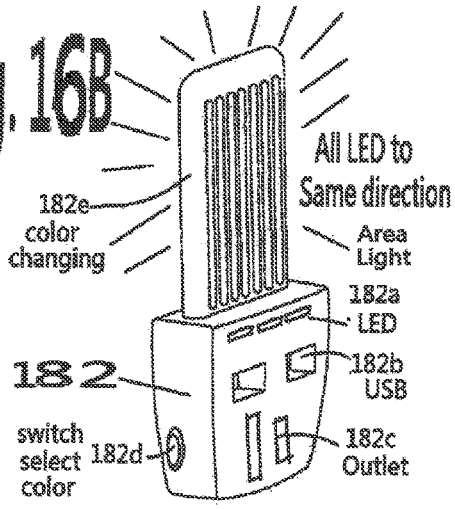
Fig. 16C
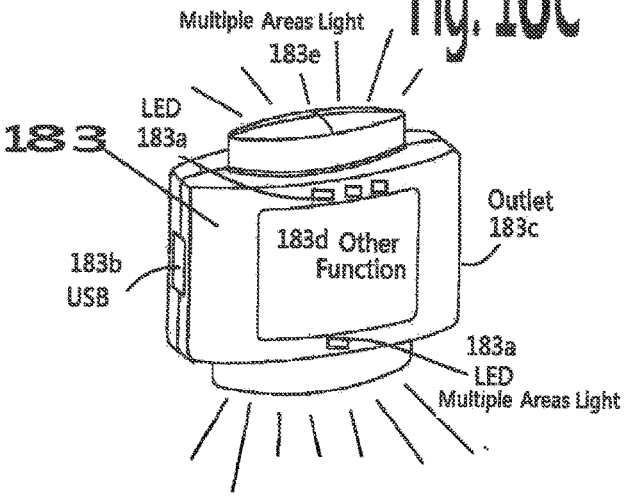
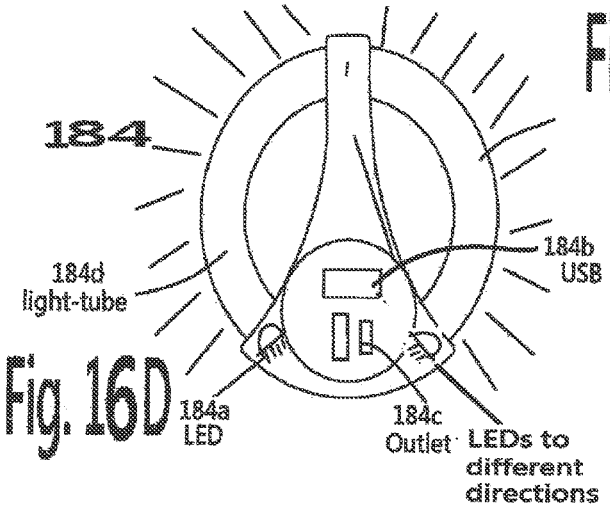
Fig. 16D
Fig. 16E
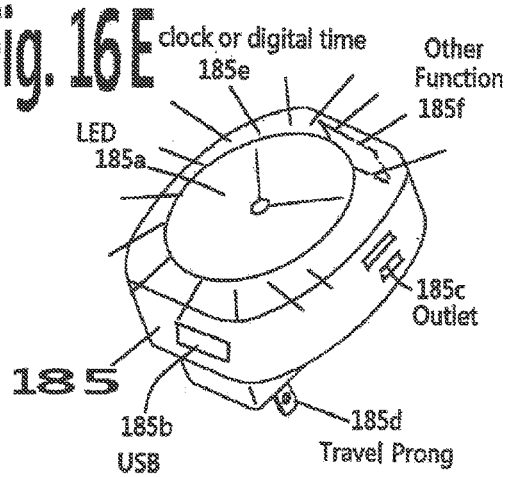

MULTIPLE FUNCTIONS LED NIGHT LIGHT

FILING HISTORY

This application is a continuation of (#R-4)
Multiple function LED night light
U.S. patent application Ser. No. 16/242,761, filed Jan. 8, 2019,
This application is a continuation of (#R-3)
Multiple function LED night light
U.S. patent application Ser. No. 14/739,499, filed Jun. 15, 2015,
This application is a continuation of (#R-2)
Multiple function LED night light
U.S. patent application Ser. No. 14/739,666, filed Jun. 15, 2015,
This application is a continuation of (#R-1) U.S. Pat. No. 10,184,624
Multiple function LED night light
U.S. patent application Ser. No. 14/739,397, filed Jun. 15, 2015, now is U.S. Pat. No. 10,184,624 issued on Jan. 22, 2019
This application is a continuation of (#R-07) (Still pending for over 12 years)
U.S. patent application Ser. No. 11/806,285, filed May 31, 2007,
This application is continuation of
U.S. patent application Ser. No. 10/883,747 filed on Jul. 6, 2004.
This application is a continuation of (#Q-07) now U.S. Pat. No. 7,632,004
LED night light with more than one optic means
U.S. patent application Ser. No. 11/806,284, filed May 31, 2007, now is U.S. Pat. No. 7,632,004 issued on Dec. 15, 2009
This application is a continuation of (#K-06)
LED night light has area-illumination by multiple time reflection and refraction20
U.S. application Ser. No. 11/498,874 file don Aug. 4, 2006
This application is a continuation of
U.S. application Ser. No. 10/954,189 filed on Oct. 1, 2004.
This application is a continuation of (M-06) U.S. Pat. No. 7,611,253
multiple functions LED night light with air freshener
U.S. patent application Ser. No. 11/527,628, filed Sep. 27, 2006, now is U.S. Pat. No. 7,611,253 issue on Nov. 3, 2009,
This application is a continuation of (#L) now U.S. Pat. No. 8,545,090
LED night light with changeable display unit
U.S. patent application Ser. No. 11/527,629, filed Sep. 27, 2006, now is U.S. Pat. No. 8,545,090 issue on Oct. 1, 2013,
This application is a continuation of (#J-6) now is U.S. Pat. No. 9,128,692
LED night light with time piece
U.S. patent application Ser. No. 14/252,102, filed Apr. 14, 2014, now is U.S. Pat. No. 9,128,692 issue on Sep. 8, 2015,
This application is a continuation of (#J5) now is U.S. Pat. No. 8,811,122
LED night light with time piece
U.S. patent application Ser. No. 13/428,086, filed Mar. 23, 2012, now is U.S. Pat. No. 8,811,122 issue on Aug. 19, 2014,
This application is a continuation of (#J-4) now is U.S. Pat. No. 8,289,814
LED night light with time piece
U.S. patent application Ser. No. 12/894,782, filed Sep. 30, 2010, now is U.S. Pat. No. 8,289,814 issue on Oct. 16, 2012, This application is a continuation of (#J-3) now is U.S. Pat. No. 8,164,984
LED night light with time piece
U.S. patent application Ser. No. 12/545,922, filed Aug. 24, 2009, now is U.S. Pat. No. 8,164,984 issue on Apr. 24, 2012,
This application is a continuation of (I-06) U.S. Pat. No. 7,568,829
poly night light
U.S. patent application Ser. No. 11/498,881, filed Aug. 4, 2006, now is U.S. Pat. No. 7,568,829 issue on Aug. 4, 2009,
This application is a continuation of (#H-1) U.S. Pat. No. 8,029,182
multiple light source night light
U.S. patent application Ser. No. 12/546,012, filed Aug. 24, 2009, now is U.S. Pat. No. 8,029,182 issue on Oct. 4, 201,
which is a continuation of (#H-05) U.S. Pat. No. 7,455,444
Multiple light source Night light
U.S. patent application Ser. No. 11/255,981, filed Oct. 24, 2005, now is U.S. Pat. No. 7,455,444 issued on Nov. 25, 2008
which is CIP of (#E-05) U.S. Pat. No. 7,909,477
LED night light with liquid optics medium
U.S. application Ser. No. 11/094,215 filed on Mar. 31, 2005 now is U.S. Pat. No. 7,909,477 issue on Mar. 22, 2011,
which is CIP of (#D-05) U.S. Pat. No. 7,997,785
Linear tube night light with changeable patterns
U.S. application Ser. No. 11/092,742 filed on May 30, 2005 now is U.S. Pat. No. 7,997,785 issue on Aug. 16, 2011,
which is CIP of (#C-05) U.S. Pat. No. 7,232,251
Night light with Fiber Optics
U.S. application Ser. No. 11/092,741 filed on May 30, 2005 now is U.S. Pat. No. 7,232,251 issue on Jun. 19, 2007,
which is CIP of (#B-05) U.S. Pat. No. 7,318,653
Multiple Function wall cover plate
U.S. application Ser. No. 11/094,156 filed on May 31, 2005 now is U.S. Pat. No. 7,318,653 issue on Jan. 15, 2008,
which is CIP of (#-04) now is abandoned
U.S. application Ser. No. 10/954,189 filed on Oct. 1, 2004 now is abandoned,
which is CIP of (#A-05) U.S. Pat. No. 7,810,985
Multiple function EL night light
U.S. application Ser. No. 11/094,155 filed on Mar. 31, 2005 now is U.S. Pat. No. 7,810,985 issue on Oct. 12, 2010,
The current invention also is continuously filing of (VVV-1)
Multiple function night light has built-in USB and light means
U.S. application Ser. No. 14/817,675 filed on Aug. 4, 2015
Which is continuously filing of (#VVV)
Multiple function night light has built-in USB and light means
U.S. application Ser. No. 13/910,295 filed on Jun. 5, 2013
Which is continuously filing of (#RRR)
U.S. application Ser. No. 13/858,604 filed on Apr. 8, 2013
Which is continuously filing of (#FFF)
Universal module has USB-unit or/and outlet-unit(s) for variety of electric or digital data device(s)
U.S. application Ser. No. 13/117,227 filed on May 27, 2011
Which is CIP of (#J4) Ser. No. 12/894,782 filed on Sep. 30, 2010,
Which is CIP of Ser. No. 12/502,661 filed on Jul. 14, 2009
Which is CIP of (#J-2) Ser. No. 12/292,580 filed on Nov. 21, 2008
Which is CIP of Ser. No. 12/566,322 filed on Sep. 24, 2009

Which is CIP of (#K) Ser. No. 11/498,874 filed on Aug. 4, 2006,

Which is CIP of Ser. No. 11/527,627 filed on Sep. 27, 2006,

Which is CIP of (#L) Ser. No. 12/622,000 filed on Nov. 19, 2009,

Which is CIP of Ser. No. 12/624,621 filed on Nov. 24, 2009,

And current invention also is Continuous filing of (#FF-1) "LED project Night Light" now is U.S. Pat. No. 8,721,160, Ser. No. 12/914,584 filed on Oct. 28, 2010, Div. of Ser. No. 12/318,470 filed on Dec. 30, 2008, May 13, 2014 issues.

Which is CIP of (#X) LED light with changeable LED position with preferable power source U.S. application Ser. No. 12/073,889 filed on Mar. 11, 2008, now is U.S. Pat. No. 8,827,511 issued on Sep. 9, 2014

Which is CIP of (#L) "LED night light with interchangeable display unit" now is U.S. Pat. No. 8,545,090

U.S. application Ser. No. 11/527,629 filed Sep. 27, 2006, U.S. Pat. No. 8,545,090 issued Oct. 1, 13I Which is CIP of (#T-1) LED light device with changeable features now is U.S. Pat. No. 8,393,755

U.S. application Ser. No. 12/894,865 filed on Sep. 30, 2010 U.S. Pat. No. 8,393,755 issued Mar. 12, 2013

Which is CIP of (#J-5) "Time piece with LED night light" now is U.S. Pat. No. 8,811,122

U.S. application Ser. No. 13/428,086 filed Mar. 23, 2012, Aug. 19, 2014 issued.

Which is CIP U.S. application Ser. No. 12/292,580 filed on Nov. 21, 2008 U.S. Pat. No. 8,305,846

Which is CIP U.S. application Ser. No. 11/527,631 filed Sep. 27, 2006.

Which is CIP of (#J-4) "Time Piece with LED night light" now is U.S. Pat. No. 8,289,814

U.S. application Ser. No. 12/894,782 filed Sep. 30, 2010,

Which is CIP of U.S. application Ser. No. 12/545,992 filed Aug. 24, 2009,

Which is CIP of U.S. application Ser. No. 12/292,580 filed on Nov. 21, 2008,

Which is CIP of U.S. application Ser. No. 11/527,631 filed Sep. 27, 2006.

Which is CIP of (#J-2) "Time piece with LED night light" now is U.S. Pat. No. 8,305,846

U.S. application Ser. No. 12/292,580 filed Nov. 21, 2008,

CIP of U.S. application Ser. No. 11/527,631 filed Sep. 27, 2006

The current invention also is continuous filing of (#III-2011)

(#M-2011)

(#KKK-2011)

All these are cover LED light or LED lamp holder or LED bulb has built-in camera and its related parts and accessories to capture the colorful image and/or audio digital data under very dark or dark environment because the said LED light source supply the sufficient brightness for camera or DV or video to take full color digital data as basic application with alternative or replaceable or equal functions or other upgrade model with wireless communication, Wi-fi, Wi-fi extender, download APP, speaker to present the image and/or audio to people computer or phone device.

and herein incorporated by reference.

BACKGROUND

The following co-pending U.S. patent applications by the same Inventor also are directed to night lights:

Ser. No. 10/883,747, filed Jul. 6, 2004; Ser. Nos. 11/092,741; 11/094,215; 11/255,981; 11/498,881; 11/527,631; 11/498,874; 11/527,629; and 11/527,628.

In addition, the Inventor's U.S. Pat. Nos. 5,926,440; 6,158,868; 6,170,958; 6,171,117; 6,280,053 disclose arrangements of conductive for night lights and multiple function night lights incorporated time pieces.

Other U.S. Pat. Nos. 4,947,291; 5,495,402; 5,662,408; 5,713,655; 5,803,579; 5,816,682; 5,833,350; 5,893,626; 5,998,928; 6,000,807; 6,010,228; 6,031,958; 6,033,087; 6,056,420; 6,132,072; 6,160,948; 6,161,910; 6,183,101; 6,190,017; 6,290,368; 6,337,946; 6,386,730; 6,390,647; 6,00,104; 6,411,524; 6,431,719; 6,509,832; 6,523,976; 6,550,949; 6,609,812; 6,623,416; 6,641,289; 6,648,496; and 6,709,126 all show different light sources and application, and none teaches an LED night light having multiple functions which may be selected from the group including an adaptor device, fan device, heat device, bug repelled device, sonic device, frequency device, or any other home electric appliance or device suitable for adding onto an LED night light.

The US prior at U.S. Pat. No. 6,431,719 show the color LED(s) with on-off or photos sensor which has only one of the translucent elements (40) as diffusor will get big bright spot lights shown out within the said super slim housing thickness. Also, '719 lack of any motion/moving/radar sensor to automatically turn on the system for pre-determined functions.

The US prior art US 2006-000-7709 which is one of center tube and the outside have the sharp tube and outside housing filed on Oct. 29, 2004 which is later than current invention parent filed case date on Jul. 6, 2004. From comparison for current invention for concept and design and application. The '709 use a tube top of one LED and current invention use a flat or any linear shape including straight-line, curve-line, sphere-line, or any other linear shape piece so can allow the at least one or plurality of lower positioned LEDs to emit light beam go through $1^{st}$ optic-lens has optics-properties or lens or protective-piece (just for light go through). This is totally different for application for $1^{st}$ optic-lens or lens or protect-piece only one LED (for '709) or plurality of LEDs (for current invention).

The Other US prior art such has liquid within the housing which is not same as any of current invention for have $1^{st}$ and $2^{nd}$ optics-lens, lens, protect-piece, or housing without any liquid within.

The other US prior arts has more than one LEDs however lack of the LED light beam go through at least $1^{st}$ and $2^{nd}$ optics-lens, lens, protect-piece, or housing with at least one or any combinations for multiple times reflection, refraction, diffusion to change the narrow viewing angle LED light beam and/or change the super-bright spot-light to even illumination is not same as current invention for LED light illumination concept and scope.

The current invention offers a big improvement in power saving because it incorporates the low power consumption Light Emitting Diode (LED) to replace the incandescent bulb which normally uses a 4 Watt or 7 Watt or more power consumption light. A single LED normally has a 0.3 Watt+/–

100% power consumption depending on the product design with desire number of additional-functions and illumination needed.

The current invention not only provides a power saving LED light-source device but also reduces a consumer's monthly electricity expense. The current invention also supplies one or more practical additional-functions to the consumer. The said practical additional-functions preferred embodiment may select from, for example, an air-freshener (as described in co-pending U.S. patent application Ser. Nos. 11/527,631; 11/527,629; 11/498,881; 11/498,874; and 11/527,628; etc.), an adaptor/receiving-end(s)/USB-port(s)/Outlet-port(s) device, sonic/IR/RF remote control device, frequency/blue-tooth/Z-way/Zig-Bee/wi-fi/internet/download APP/or other wireless device, bug repelled device, second or more LED light-source or applications or light device, timepiece, electric message device, timer device, temperature device, surge protection device, electric short circuit protection device, additional circuit having motion sensor or moving sensor or radar sensor incorporate with photo sensor for at least 2 sensor combinations, additional switch to select prefer color from more than one color(s), additional switch to select one functions out of more than one light function(s), base device for installation on an existing lamp socket has AC wired or prong, emergency/power fail light device with recharge or regular battery or backup power, or any other electric device(s) used in a home to keep people comfortable or safe.

This current invention optionally may further incorporate the teachings of the co-pending application entitled "U.S. Pat. No. 7,455,444, issued date on Nov. 25, 2008 which is U.S. application Ser. No. 11/255,981 filed on Oct. 24, 2005 Publication Ser. No. 2006/0152 946 Publication date on Jul. 13, 2006 for (#H-05) LED night light with more than one LED light source" concerning the LED night light have more than one LED light-source(s), and "U.S. Pat. No. 7,632,004 issued date on Dec. 15, 2009 which is U.S. application Ser. No. 11/806,284 filed on May 31, 2007 Publication Ser. No. 2008/0304 289 Publication date on Dec. 11, 2008 for (#Q-07) LED night light with more than one optic element(s)" concerning the inclusion in the LED night light of an optical element that improves the visibility of light beams from the LED. Both co-inventor patent cases all issue date is later than current invention parent filed date on 2007 as above filing history.

All existing LED nightlights have the big problem that the LED unit can be seen by a viewer over a narrow viewing angle only, and that the brightness within that angle is too strong, resulting in spot-light effects (super bright in a small area). The co-pending application (#Q-07) teaches multiple (more than one) optics to provide a big illumination-area [FIG. 9 (9*a*)] and a big improvement from spot-light to linear or big-area in geometric-shape brightness, thereby causing the spot-light effects to change to a nice looking lighting effect such as [FIG. 9 (9*a*)] that provided by a LED light and more than one optic-element(s) as parent filed case (#Q-07) in preferred arrangement. It is very difficult to use only one piece of optics-element(s) or optics-lens to cause the strong spot-light LED unit(s) to have nice and warm light with even-brightness for big-area effects [FIG. 9 (9*a*)] that can be seen by a viewer. The current solution is having one tubular or dome or flat lens in front of the LED light source and have at least one of detachable or replaceable or changeable second or more optic-element(s) to diffuse the inner lower positioned LED light source which installed within the prong-base unit. This is a current solution basing on parent (#Q-07) filed case technical which have big improvement in the LED night light.

The current invention further adds preferred at least one of other arrangement such as reflector(s), bubble(s), or lens(es) within or fit the said LED night light to increase the effects of modifying the narrow viewing angle light beams emitted out of the LED(s) to provide linear or area light effects. It is appreciated that the said at least one of second or more detachable or replaceable or changeable optic-element(s) with more than one light-emit-out window, opening, holes, shape cut-out to fit within the prong base groove, ditech, gaps as parent filed case (#Q-7) with color changing or additional switch to select color should still fall within the current invention claim coverage basing on the parent filed (#H) and (#H-1) alternative or equal functions for LED night light have more than one LED light source(s) and light beam emit out through more than one of the opening(s), window(s), printed area(s), panting area(s).

Furthermore, the current LED night light invention solves several problems with the most night light in the market place. The most night light total length is around 88 mm+/−50 mm (with base), The only lens height is around 60 mm+/−30 mm (without base). The height from the wall outlet cover is around 35 mm+/−15 mm (from outlet cover surface). If the LED unit is placed on the same location as the outlet cover surface, the distance from the wall to the outside lens will be less than 35 mm+/−15 mm, which is too short to make the spot-light LED's into a surface or area photometric or lighted area. The problem is solved by using two optic element(s) to get a good surface or area lighting effect or by put at least one LED(s) on bottom or top or sides and LED light beam emit to LED light inner surface(s) back and forth for multiple times reflected and/or refracted to increase the LED light-travel distance with or without optics reflective, diffusor, refractive medium between light-beam traveling path(s) to help light traveled, reflected, refracted for multiple times to make the LED light-source spot light become even area-illumination. This concept is same as co-pending filed case (#K-2006) for area-illumination arrangement which is U.S. application Ser. No. 11/498,874 filed on Aug. 4, 2006 Publication number US 2007/007-6437 publication date on Apr. 5, 2007 which is CIP of U.S. application Ser. No. 10/954,189 filed on Oct. 1, 2004. In addition, the LED night light power consumption will fall within the 0.3 W+/−100% per LED range, whereas the power consumption of a incandescent bulb night light falls within 4 Watt+/−50% per bulb. So, the LED night light will have a big power saving and reduce the monthly electric bill for the consumer.

The current invention not only provides a simple multiple functions LED night light, but also provides excellent light performance. The LED night light have more than one functions, The preferred embodiment(s) can add at least one of circuit or device or function selected from, by way of example, an adaptor or USB(s) or Outlet(s) or audio-plug or memory-card slot(s) device, motion or moving or radar or motion+screen/display auto-comparison or other combination-sensors or others sensor device, PIR sensor device, air freshener, second LED function light device, bug repellent device, sonic repellent device, surge/short circuit/overheat/overload protection device, emergency/power fail with backup rechargeable or regular-battery light device, time device, timer device, additional switch to select the one color from multiple color(s), additional switch to select one of preferred light function from multiple functions(s), wireless control or connection related device including IR/RF/Remote control/blue-tooth/Z-way/Zig-Bee/Wi-fi/download APP software/Internet/3 or 4 or 5G network, or any combination so the LED night light can be have nice light performance with more than single functions.

It is appreciated all above discuss the current invention and co-listed above all parent filed or child filed case(s) all concept, idea, designs, drawing, claims with alternative, replaceable, up-grade, improvement idea, concept, design should still fall within the current invention as above discussed filing history each parent filed or continuous filing case and background each concept should still fall within the current invention claim coverage in spite without each above discussed parent or continuous filing case drawing show on this filing text.

BRIEF DRAWINGS

FIGS. 1-4 are perspective views taken from different viewing angles showing a first one of preferred embodiments of a multiple function of LED night light.

FIG. 5 is a partially cut-away front view showing construction details of the 1$^{st}$ one of preferred embodiments illustrated in FIGS. 1-4.

FIGS. 6-10 are perspective views at different viewing angles of a second one of preferred embodiments of a multiple function LED night light.

FIGS. 14, 14A, 14B, 14C, 14D, 14E, 15, 15A, 15B, 15C, 15D, 15E, 16, 16A, 16B, 16C, 16D, 16E shown some exemplary embodiment(s) for multiple function(s) LED light having LED for at least one LED illumination area with at least one of additional circuit(s), device(s), functions built-in the said LED light.

FIGS. 17A, 17B, 18, 18A show LED night light having (a) more than one optic-elements and (b) more than one of LED light source(s) emitting light beam from more than one of area(s), window(s), body(s); between (i) the parent filed case as FIG. 16 and (ii) alternative or replaceable or upgrade of current invention as FIG. 16A.

DETAILED DESCRIPTION

Figure 11:
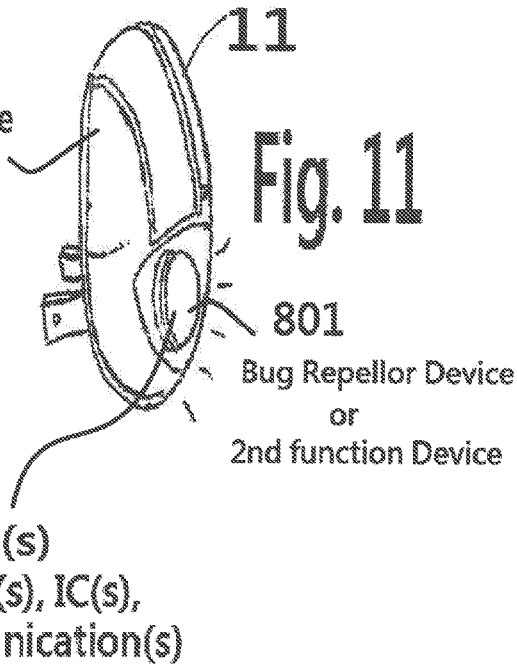
FIG. 11 is a perspective view of third one of preferred embodiments of a multiple function of LED lite having at least one of additional functions, circuits.

FIG. 1 shows a first preferred embodiment of a multiple functions LED night light (1) in which the one of preferred added function is adaptor/outlet device (20) with ground-pole. The added function(s) (20) may alternatively be selected from the devices described in FIG. 11 shown bug-repelled (801) or-and the 2$^{nd}$ electric device (803) or-and co-pending U.S. patent application Ser. Nos. 11/527,631; 11/527,629; 11/498,881; 11/498,874; and 11/527,628 etc., such as an (i) air freshener, fragrance refill piece, liquid or wax fragrance or de-order piece as [FIG. 3 (25)]

Figure 12:
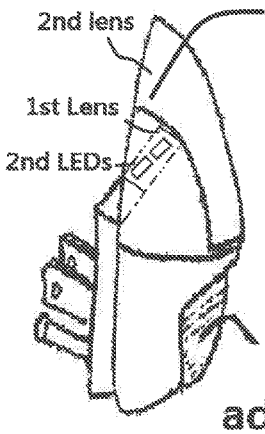
FIG. 12 is a perspective view of a fourth one of preferred embodiments of a multiple function LED night light having at least one of desire sensor(s) or additional switch or additional circuit(s) to perform desire one or more additional function(s).

(ii) adaptor/USB-port(s) FIG. 2 (22*b*) (22*c*)/Outlet(s) FIG. 1 (20), FIG. 2 (20*a*)/Audio output or receiving port or other ports(s) FIG. 7 (7M)/memory receiving slot(s) or USB ports FIG. 8 (8*h*) (8*i*) device as [FIG. 1 (20), FIG. 2 (20*a*) (22*b*) (22*c*), FIG. 7 (7M), FIG. 8 (8*h*) (8*i*), FIG. 9 (9*c*,9*e*,9*l*), FIG. 10 (10*d*) (10*e*)], (iii) sonic repelled FIG. 6 (6*k*)/mouse repelled FIG. 12 (803)/mosquito high-voltage shock or terminator FIG. 12 (803) device, [FIG. 11 (801), FIG. 12 (803)]

Figure 13:
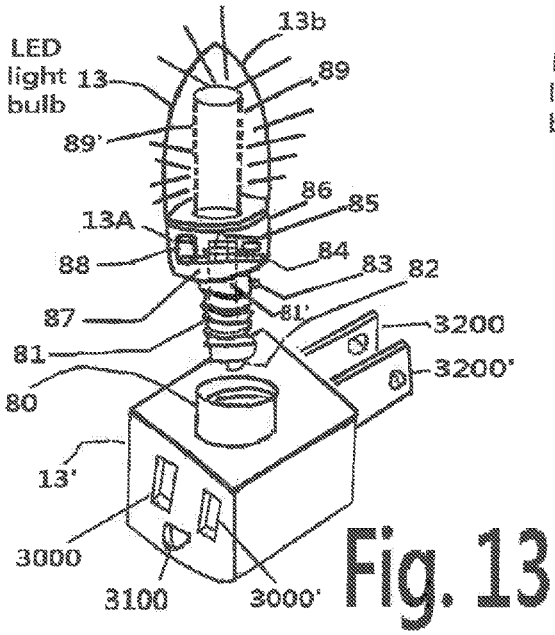
FIGS. 13 and 13A is a perspective view of a fifth preferred embodiment of a multiple function of LED Bulb incorporate with a base device which connect with AC outlet by wire or by prong-base and the said LED bulb for installation on an existing lamp socket having AC current.
Figure 13A:
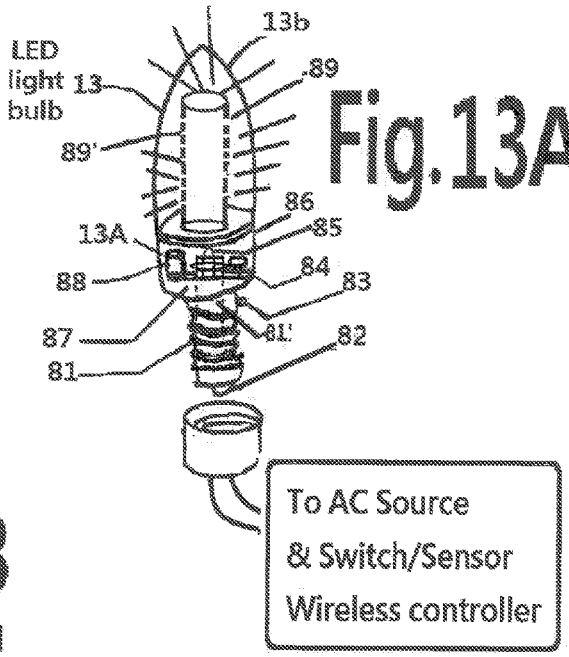

(iv) frequency/wireless transmitting FIG. 7 (7*i*) and/or receiving FIG. 7 (7*h*)/blue-tooth FIG. 7 (7*n*)/Z-way FIG. 7 (7*n*)/ZigBee FIG. 7 (7*n*)/IR FIG. 7 (7*n*)/RF remote control FIG. 7 (7*n*)/wi-fi FIG. 7 (7*n*)/router/APP download software/internet/3.4.5G network device [FIG. 7 (7*h*) (7*i*)], (v) bug repelled device FIG. 11 (801) [FIG. 6 (6K)], (vi) Second or power fail FIG. 6 (6*j*), or emergency light FIG. 9 (9*j*) or other 2nd light FIG. 9 (9*i*) device as [FIG. 5 LEDs (60) (70), FIG. 4 LED (01), FIG. 9 power fail/emergency LED light source (9*i*) (9*j*)], (vii) USB port FIG. 8 (8*h*) (8*i*) for input power for internal battery FIG. 7(7*k*) or for output for charging other be-charge device with Micro-USB, Type A FIG. 2 (22*a*), Type C FIG. 2 (22*b*) or preferred USB ports [FIG. 2 (22*a*) (22*b*)], (viii) electric message device FIG. 7 (7*h*) (7*i*) as [ FIG. 7 (7*h*) (7*i*) for wireless transmitter and/or receiver], (ix) timer FIG. 10 (10*e*)/temperature FIG. 10 (10*e*)/timepiece FIG. 19 (10*e*)/device [FIG. 10 (10*e*)], (x) power-bank FIG. 7 (7*k*) having USB port FIG. 7 (7M) and rechargeable battery FIG. 7 (7*e*) device [FIG. 7 (7*e*) (7M)], (xi) surge protection FIG. 6 (6*g*) FIG. 10 (10*f*) device [FIG. 10 (10*f*), FIG. 6 (6*g*)], (xii) electric short circuit protection FIG. 10 (10*f*) device [FIG. 10 (10*f*), FIG. 6 (6*g*)], (xiii) base device FIG. 13 (13') for installation on an existing lamp socket FIG. 13 (80) as [FIG. 13 (13') or FIG. 13A (13")], (xiv) emergency FIG. 9 (9*j*)/power fail light FIG. 6 (6*j*) device as [FIG. 9 (9K) (9*i*) (9*j*) (9*h*)] [FIG. 6 (6*j*)], or (xv) wire-arrangement FIG. 8 (8*j*) FIG. 3 (23) for LED night light have USB-port FIG. 1 (22), FIG. 2 (11*a*) (22*b*), FIG. 3 (23), FIG. 8 (8*j*) slot FIG. 3 (23), groove FIG. 8 (8*j*), ditch FIG. 8 (8*j*) as [FIG. 3 (23), FIG. 8 (8*j*), FIG. 3 (23), FIG. 8 (8*j*)]

(xvi) Audio FIG. 3 (24)/sound FIG. 3 (24)/music device FIG. 3 (24) by pre-record or memory-units FIG. 7 (7M) or blue-tooth FIG. 7 (7*h*) or wi-fi FIG. 7 (7*h*) connection as [FIG. 3 (24)]

(xvii) a camera FIG. 7 (7N) and/or a wireless communication FIG. 7 (7*h*) device the data storage FIG. 7 (7M) device is a memory unit, SD card, micro SD card, to enable a photo, video, or sound to be saved into the data storage device and/or wireless transmitted or communicated to another electric device as [FIG. 7 (7N)].

(xviii) Motion sensor FIG. 1 (28), FIG. 9 (9*g*), photos sensor FIG. 7 (7*j*) or other moving, radar sensor(s) FIG. 1 (28), FIG. 9 (9*g*), FIG. 7 (7*j*), wireless controller FIG. 7 (7*h*), IR or RF remote controller system FIG. 7 (7*i*) can activate the said LED illumination for hand-free or by remote-controller for walk-free.

These additional functions made by built-in circuit or IC to create multiple functions which is much better than co-inventor's parent filed cases since 2004 when the white LED light just present at market place. These additional function beside the simple LED illumination for just On-Off is the important features of current invention filed from 2004 and these additional functions is good to keep people comfortable or safe. The added function(s) may be one to N (any number) to make a very practical multiple functions LED night light.

As shown in FIG. 1, the multiple function LED night light (1) has a back housing (10) assembled with a front housing and arranged to capture prong (30) (30') (31) within and enable delivery of electricity from the outlet AC power source through the one of the preferred adaptors is outlet-device (20) to supply AC current the other electric appliance device (not shown). One of preferred embodiment for an optics-lens (40) exhibits light effects from the inner two-ends LED or LEDs (not shown) to provide a light performance having predetermined functions, time, duration and so forth as required.

From FIG. 1 the said LED(s) is get power from AC outlet and go through the inner AC-to-DC or preferred IC (100), switch (28), motion sensor (28), photo sensor (28), or desired switch and sensor combination (s) (28) to trigger, control the LEDs for on and off. The current invention preferred to make an upgrade or alternative arrangement may incorporate with IC (100) and/or switch(s) (101) to get at least one of color changing, color selection, and function selection to get desired light functions. This is $1^{st}$ important features for current and parent filed case to have added IC (100) and selection switch (101) to increase the additional function(s) to get color changing, color selection, and functions selection such one of preferred exemplary case for motion sensor or none-motion sensor.

From FIGS. 2, 3, 4 show the multiple function LED night light of FIG. 1 from different viewing angles and more added IC (100), select switch (101) circuit or additional function(s) which not present at market before 2004 when the co-inventor parent filed time.

From FIG. 2 show the LED night light (2) have built-in at least one of LEDs for desire multiple functions than the earlier old night light before 2004 just for simple LED illumination lack of multiple colors LED(s), $2^{nd}$ or more LEDs to emit light beam to $1^{st}$ and $2^{nd}$ lens or optics-lens go through multiple time reflection and refraction within the night light housing to get one of preferred light effects such as even brightness on areas or indicator light(s).

FIG. 2 show the night light (2) have built-in additional-functions preferred including the outlet-device (20*a*) which can be a rotatable construction, USB charging or receiving port(s) (22*a*) (22*b*) select from type A (22*a*) or type C (22*b*) or other preferred or alternative type of USB such as micro-USB or mini-USB or other market available type for charge external be-charged products by USB ports(s) (22*a*) and charged inside built-in rechargeable battery from USB port (22*b*) type C or micro USB (22*b*) or mini USB (22*b*).

The Outlet (20*a*) deliver the prong input AC to other be-supplied products.

While the LED night light is plug-into or un-plug from AC outlet, the LED night light additional USB-port (22*a*) or USB-port (22*b*) can perform the USB charger function to charge other products while has AC power connected, or While the night light lost AC power, night light offers the power to other products from USB-ports while night light act as a Power bank functions while the LED night light have built-in rechargeable battery as FIG. 4 (26).

The night light has both (a) USB charger function while LED light is plug-into AC outlet power source and (b) Power bank functions while LED light un-plug from AC outlet power-source. This is the 2nd feature of the current invention and also disclosure on above filing history for some parents filed case(s).

From FIG. 3 show one of preferred embodiments have preferred additional-functions not only for LED night light illumination but also preferred having audio function (24), air-freshener function (25), wire arrangement function (23) to arrange USB-wire related wire can be well coiled or rolled or storage within the LED night light built-in or added-on wire-arrangement design which at least is one of gap (23), glove (23), ditch (23), pole (not shown), bar (not shown), holder (not shown), foldable rack (not shown). There construction some of exemplary shown on FIG. 14A (169*e*), FIG. (170*e*), FIG. 14E (173*f*) and co-pending file case U.S. application Ser. No. 14/817,615 (FIG. M) filed on Aug. 4, 2015 and is CIP of U.S. application Ser. No. 13/910,295 filed on Jun. 5, 2013 now is U.S. Pat. No. 9,732,921 issue on Aug. 15, 2017. These wire arrangement for LED plug-in light is other important features of parent filed case and current invention and co-pending filed cases. This is $3^{rd}$ important feature of current and parent filed case.

FIG. 3 show the light beam travel path (6*f*), the at least one or more LEDs emit light go through the $1^{st}$ and emit into the $2^{nd}$ lens or optic-lens inner surface(s) and go through multiple times at least one of reflection or refraction or diffusion and make the $2^{nd}$ lens or optic-lens to have even brightness. The said at least one LEDs (not shown) emit to same optic-lens or $2^{nd}$ lens from different location. It is appreciated that the at least one of LED(s) can be white color or desired multiple color so can incorporate IC and/or select-switch to get color changing, color selection, functions selection, sequential or fade-in or fade out for desired light show.

It is also appreciated the at least one LED(s) can emit to the same or different location(s) as co-inventors (#Q-07) now U.S. Pat. No. 7,632,004 LED night light with more than one optics means U.S. patent application Ser. No. 11/806,284, filed May 31, 2007, now is U.S. Pat. No. 7,632,004 issued on Dec. 15, 2009 show the at least one of LED(s) emit light go through the geometric shape $1^{st}$ optic-lens or protect lens may in linear or tube or flat or curve which all belong to linear shape and light-beam go through the $2^{nd}$ optic-lens or lens or top housing which is assembled into base by market available skill such as snap-tight or others. The light beam emits out from LED(s) and emit to the linear construction optic-lens or lens with top or tip or other reflective surface surrounded for LED light beam to be reflected and body multiple reflection and refraction to change LED narrow angle emit light to wider angle emit LED light beam emitting out from $1^{st}$ optics-element and go through the $2^{nd}$ optic-lens or lens to spread to whole area of $2^{nd}$ optics-lens or lens for desired illumination. It is appreciated the current invention upgrade the said linear $1^{st}$ optic-lens or lens that is including all kind of geometric injection or other proceed piece in short dome, sharp top, or flat, linear-shape, or other geometric shape put in front of LED(s) to prevent people to touch or having texture or diffusor optic-function or change light beam emit-angle especially the $2^{nd}$ optics-lens or lens alternatively having open-back housing and not sealed unit so need the $1^{st}$ optic-lens or lens to prevent people to touch. This is one of alternative arrangement of the co-inventor parent filed case which show on the Parent filed case text (#R-2007) Column 1 of issued patent. The current invention makes big improvement to have flat or linear shape $1^{st}$ optic-lens or lens or protect lens so can allow the multiple piece of LED(s) can emit light go through the $1^{st}$ optic-lens, lens, protect lens, diffusor lens because parent file case if the linear piece is a tube or cone shape as FIG. 18 it only allow one piece LEDs to emit light to $2^{nd}$ optics-lens, lens, housing. So, tis is big improvement to let night light can have more than one LEDs to get desired colorful or other desired light effects.

It is also appreciated that the current invention is CIP filed case of the parent filed case (#H-05) U.S. Pat. No. 7,455,444 Multiple light source Night light U.S. patent application Ser. No. 11/255,981, filed Oct. 24, 2005, now is U.S. Pat. No. 7,455,444 issued on Nov. 25, 2008. The (#H-2005) disclosure the more than one LEDs. The $1^{st}$ LED to emit light to optic-lens or lens the light transmitting-area(s) and/or opening(s), window(s), and the $2^{nd}$ LED or LED(s) emit light beam to other or same transmitting-areas. It is appreciated that the current invention has update improvement including at least one preferred embodiment having more than one LED(s) also can emit to the same or different LED light one or more same or different location parts or lens transmitting-area(s) and/or opening(s) as FIG. 6 show the light beam travel path (6*f*) (6*f'*) (6*f''*) show.

From Both Co-inventor Parent filed case (#H-2005) (#Q-2007) and (#R-2007) have listed all the features, alternative, equal functions and more than one LED(s) light beam traveling path show on FIG. 3 and FIG. 6 for LED night light has 1. "(#H-2005) for More than one LEDs", and
2. "(Q-2007) for more than one of Optics-lens", and
3. "(#R-2007) more than one of Functions"

And (#R-2007) (#H-2005) shown all the parent filed cases (Ser. No. 10/883,747) file on Jul. 6, 2004 back to 2004 or more earlier date.

It is appreciated that all co-inventor above listed and all above discussed text, concept, idea, construction, application and its alternative, equal functions arrangement or skill should all still fall within the current invention scope, idea, concept and claim coverage without limitation.

Hereof, the said $2^{nd}$ LED or more than one LEDs is one of (1) single color, (2) multiple color, (3) plurality number of LEDs, (4) chip or dice or dip or COB LED may incorporate with IC and circuit and other electric parts to get desired light show or light effects.

And, One or $2^{nd}$ or more LED light beam emit to at least one of (a) Same or different housing light transmitting-areas for multiple time reflection and refraction, and/or (b) same or different housing opening, windows to emit the light-beam to be seen, and/or (c) One or more LED light beams emit to same or different $1^{st}$ optics-lens or lens and go through the same or different $2^{nd}$ optic-lens or lens at least one of transmitting-area(s) for reflection and refraction, and/or emit out from openings, windows, shape holes of $2^{nd}$ optic-lens or lens or housing which including cartoon character shape housing with preferred art, design, treatment, texture, or other arrangement on surfaces.

From FIG. 4 show one of preferred embodiments has preferred additional-functions not only for LED night light illumination by more than one LEDs, optic-elements, functions as above discussed with FIGS. 3, 6, 17B,18 but also preferred having at least one of rechargeable or non-rechargeable battery (26) for backup power source while the AC power-source shut-down.

The said backup battery (26) that supply the power for LED(s) for power fail or emergency light or hand-held flashlight with desire on/Auto/Off select-switch while AC power failed or night-light un-plug on outlet so simple LED illumination night light can have (1) power fail light function, (2) flashing light, and the said power fail light or flashlight light beam emit out from same or different area or windows, openings, location of LED light body which is fall within the co-invention parent filed case claim coverage as (#H-2005) LED light has more than one LED light source(s) and its parent filed case. The parent filed is (#H-1) U.S. patent application Ser. No. 12/546,012, filed Aug. 24, 2009, now is U.S. Pat. No. 8,029,182 issue on Oct. 4, 201 for multiple light source LED night light, which is a continuation of (#H-05) U.S. Pat. No. 7,455,444 U.S. patent application Ser. No. 11/255,981, filed Oct. 24, 2005, now is U.S. Pat. No. 7,455,444 issued on Nov. 25, 2008 Multiple light source LED Night light This features still fall within the current invention basing on the (#H-2005) is parent filed case of the current invention parent filed case (#R-2007) and parent filed case of (#R-2007) (Ser. No. 10/883,747) file on Jul. 6, 2004 back to 2004 and other parent filed cases.

The said while AC power loss, the inner detector or sensor or IC or circuit will change power-source from AC to back-up battery (26) and supply the power to the said LED (01) on base of the LED night-light or-and power-fail LED(s) as FIG. 9 (9*i*) (9*j*) on top of the LED night-light housing or alternative locations.

The wire (1*w*) (2*w*) get AC power from AC power source to get into IC (100) or preferred detector or sensor or circuit (50*a*) and circuit have wire or PCB traces (3*w*) (4*w*) to connect with LEDs (01), and circuit have wire (5*w*) (6*w*) to connect with the backup battery (26). The IC (100) or preferred detector or sensor or circuit (50*a*) has pre-determined design for AC-to-DC or preferred circuit to get DC power for area or desire effect of light to work and DC powered additional function including above discussed 21 type but not limited for these 21 exemplary items while AC power source existing. And, DC powered additional function such as power fail or flashlight work while the AC power source is lost. The circuit (50*a*) has pre-determined charging system to charge rechargeable battery and detect system to detect AC power is lost and activate the power-fail circuit and turn on the power fail or flashlight LED(s) at the same time circuit change AC current to battery DC current while AC power lost. This is $4^{th}$ important features of current invention and parent filed cases.

FIG. 5 shows details of one of the preferred embodiment FIG. 1 the inner construction of the multiple function LED night light (5) which has a back housing (103) and which holds an optic-lens or optics medium (400) having a ring design which is adjacent a circuit board (50) that connected to prong (300) (300') to deliver input home electricity to circuit-board (50). And, the LEDs (60) (70) powered by circuit (50) and switch or sensor to turn on the LEDs (60) (70) to emit a light beam into the ends (60') (70') of optic-lens or optics medium (400) from the two input ends. The preferred ring optics-lens or preferred optic-medium (400) has input ends having "U" shaped or recess-arrangement so as to allow as many of the light beams emitted from the LEDs (60) (70) to enter the optional $1^{st}$ optics-lens or $1^{st}$ lens (60') (70') and emit into optics medium (400) as much as possible.

Some alternative or replaceable applications may have other designs for the optic-lens or optics medium or housing or $2^{nd}$ optic-lens or $2^{nd}$ lens (400) which can be any geometric shape at least including FIG. 1, FIG. 6, FIGS. 14 to 18 as preferred housing or $2^{nd}$ optic-lens or $2^{nd}$ lens and some alternative or replaceable design for the said input ends or $1^{st}$ optic-lens or $1^{st}$ lens, which is not a limitation for the current invention's preferred embodiment description is ring or circle tube or shape disclosure from FIGS. 1 to 18A of current invention, it can be any geometric shape which at least including $2^{nd}$ optic-lens or $2^{nd}$ lens or housing is one of cartoon character shape.

The input ends or $1^{st}$ optics-lens or $1^{st}$ lens or $2^{nd}$ optics-lens or $2^{nd}$ lens or housing design can be any type which is still within the current invention scope. The alternative or one of preferred receiving port such as USB-port (not shown) or receiving prong of AC outlet is grounded type (310) to provide more safety for the AC outlet device. This AC outlet prong arrangement can be varied including without ground-pin (310) or foldable-prongs depending on the different requirements of safety authorities or governments.

The optic-lens or $2^{nd}$ optics-lens or $2^{nd}$ lens or optics medium (400) and of FIG. 5 may have different arrangements or texture or treatment that 1. $1^{st}$ optics-lens or $1^{st}$ lens or $2^{nd}$ optics-lens or $2^{nd}$ lens or optics-medium (400) having sand-blasting or white pigment mixed with plastic-resin or colored the plastic-resin or painting or printing to make the surface very rough and allow all the light to travel within and have diffusion effects without excess leakage or 2. $1^{st}$ optics-lens or $1^{st}$ lens or $2^{nd}$ optics-lens or $2^{nd}$ lens or optics-medium (400) having a plurality of the air-bubbles (or equivalent reflectors) inside the tube-like or linear-like (including flat or curved piece) optic-lens or optics medium, or 3. $1^{st}$ optics-lens or $1^{st}$ lens or $2^{nd}$ optics-lens or $2^{nd}$ lens or optics-medium (400) is flat with curvature big-piece with opaque or milky or white color to make even brightness of illumination.

It is appreciated for one of alternative design of the said $1^{st}$ optics-lens or $1^{st}$ lens or $2^{nd}$ optics-lens or $2^{nd}$ lens or housing or optics-medium (400) cause light beams from the LEDs to exit the desire geometric-shape $2^{nd}$ optics-lens or $2^{nd}$ lens or housing or optic-lens or optics-medium big-surface (400) not from the ends, to make whole piece or big-surface of $2^{nd}$ optics-lens or $2^{nd}$ lens or housing or optics-lens or-and optics-medium (400) with splendid even brightness shown on the night light surface and it is not the light effects like some liquid items to show light on top of LED locations and outside nigh light. Or, the $2^{nd}$ optics-lens or $2^{nd}$ lens or housing or optic-lens incorporate built-in plurality of reflectors or air-bubble within the linear or tube optic-lens to create alternative light performance shown plurality of reflected light-beam or lighted-sports showing along the very low dome shape (even a flat piece), linear piece including flat or curve shape, tube length with reflective top or narrow-tip of the medium as FIG. 1 to FIG. 5 and FIG. 17A (32) (32') for linear or tube illumination with or without reflected brighter-sports or plurality reflected light-beams or FIG. 6 to FIG. 10, FIG. 15A for $2^{nd}$ optics-lens or $2^{nd}$ lens or housing big-area having even brightness illumination. It is appreciated the current invention the said LED light for this filed case and claim coverage has at least one of $1^{st}$ and $2^{nd}$ optics-lens, lens, protect lens, housing parts to make the LED light beam to travel through $1^{st}$ and go to $2^{nd}$ and each of $1^{st}$ and $2^{nd}$ optics-lens, lens, protect-lens or housing have it preferred optic-properties including at least one or any combination of reflective, refractive, diffusion, passing through, protective functions and the said LED light beam has multiple times traveling within the LED light housing to make big improvement to ger desire wider LED light viewing angle or/and without super-bright spot light to be seen.

As shown in FIGS. 5 to 10, the circuit (50) may incorporate at least one or desired combination of electric components selected from resistor, capacitor, switch, sensor, diode, inductor, transformer, integrated circuit (hereafter as IC), AC-to-DC circuit (50), surge protector circuit as FIG. 10 (10*f*), USB charging or be-charging circuit FIG. 2 (22*a*) (22*b*) (8*h*) (8*i*) (10*e*), power-failed circuit FIG. 9 (9*h*) (9*i*) (9*j*) (9*k*), emergency light circuit FIG. 9 (9*h*) (9*i*) (9*j*) (9*k*), wireless transmitting and/or receiving circuit FIG. 7 (7*h*) (7*i*), audio-circuit FIG. 3 (24), sonic repelled circuit FIG. 6 (6*i*), air/fragrance/humility/liquid/moisture diffusor circuit FIG. 3(25), power bank with rechargeable batteries and USB ports FIG. 7 (7*k*) (7M) (7*e*), time/temperature/timer circuit FIG. 10 (10*e*), motion/photo/moving/radar detector or sensor FIG. 1(28) FIG. 6 (6*i*), FIG. 7 (7*j*), FIG. 9(9*g*) or sensor+screen comparison-system, mobile device screen (not shown), or any available components suitable for electrically driving LED(s) to have predetermined functions, duration, time, effects, and/or brightness.

The appropriate conductive-piece(s) used for the electric connection to the USB-ports (not shown) or AC outlet prong (300) (300') (310) and LEDs (60) (70). The said conductive-piece(s) can be obtained from the marketplace and may include electric wires, and/or a wire-harness, cable, spring, metal piece, or other conductive-piece(s) use for USB-port(s) or AC-outlet female conductive-piece to supply power without departing from the scope of the invention, as long as an electric signal or AC or DC power can be delivered from the circuit (50) to the USB export ports or AC outlet prong and LEDs. It is appreciated the said USB-port(s) can be any type select from market available type including Type A, B, C, D, E, F, Mini, micro for receiving or supply the DC current input or output the said multiple functions LED night light.

FIGS. 6-10 show the same and upgrade features as FIGS. 1-5, the difference being the different $1^{st}$ optics-lens or $1^{st}$ lens or $2^{nd}$ optics-lens or $2^{nd}$ lens or housing and optic-lens design with different space to arrange the LEDs, prong, circuit, and additional-functions device(s) on the LED night light.

From FIG. 6, The said LED light base (6*a*) has circuitry inside to change AC current from outlet into desired DC current for inner all kind of LED or LED(s) light source(s) to turn-on and turn-off with desired simple or IC controlled functions. The LED or LED(s) light-beam emit to the $1^{st}$ preferred $1^{st}$ optics-lens or $1^{st}$ lens or $1^{st}$ optics-medium (6La) which has preferred geometric shape such as but not limited for flat or linear-shape (exemplary one of curve line or straight line from side view) with or without treatment(s) to make at least one or plurality number lower positioned narrow emit-angle LED or LED(s) light beam to passing through or spread out to whole or big-size surface of the said $2^{nd}$ optics-lens or $2^{nd}$ lens or housing or optics-medium (6*d*) (6*c*).

One of preferred embodiment that the light beam (L1) emit out from one or more than one piece of LED (6L) passing through the $1^{st}$ optics-lens or $1^{st}$ lens or $1^{st}$ protective lens (6La) and emit to the $2^{nd}$ optics-lens or $2^{nd}$ lens or housing top area(s) to reflected back to become light beam (L2) and reflected by $2^{nd}$ optic-lens or $2^{nd}$ lens to become light beam (L3) and hit the other areas of $2^{nd}$ optics-lens or $2^{nd}$ lens to get reflected light beam (L4) and refracted light beam (L5). This is one of exemplary embodiments for the LED light beam emit to $1^{st}$ and go through the $2^{nd}$ optics-lens or lens with desired treatment to make the light-beam spread out from surface of the $2^{nd}$ optics-lens or $2^{nd}$ lens or housing light transmitting or passable or emitting area(s) or window(s) or cutout(s) or shape hole(s) after multiple time of at least one or any combination of reflection, refraction, diffusion to make the LED bright spot narrow emit-angle light beam to become areas light effects. It is appreciated, other light beam traveling such as the 1st optics-lens or lens or protect lens may have diffusor or just protective function to get different arrangement as above one of the preferred embodiments.

The said light effects can be single color or multiple color or auto color changing under IC (100) controlled or select-color(s) by select-switch FIG. 1 (101). This is one of exemplary embodiment, the light beam traveling within the 2nd optic-lens or 2nd lens which can be any geometric shape such as FIGS. 1 to 5 is linear or tube or circle piece, or FIG. 6-10 is sphere or cartoon character or ½ egg or other preferred shape, or FIGS. 14 to 16 for variety of rectangular, oval, square, tube, cylinder, or alternative any geometric shape with or without built-in optics-treatment, and/or wire-arrangement construction.

One of preferred embodiments, the other 2nd optics-lens or 2nd lens or housing different between optics-lens (400) and optic-lens, lens, housing (6*d*) (6*c*) at the shape and inner and optics-arrangement or optic-properties of lens construction.

The said FIG. 5 show 2nd optics-lens or 2nd lens or housing preferred is solid or hollow circle or donut or arc shape while it is (1) a solid-piece may have air-bubble or tiny reflectors inside or (2) a hollow-piece may have heavy texture on outside surface to get desired light performance. Or the tube-like or circle or donut or arc shape having empty space to fill up plurality of reflected-piece. And optic-lens (400) emit light from whole body or length to let people see the illumination for big-area(s) not the ends. The 2nd optics-lens or 2nd lens or housing of FIGS. (6*c*) (6*d*) or FIGS. 14 to 18A is different light performance that required whole sphere or flat surface have even brightness without any brighter-spots or not even brightness existing.

The optics-lens (6*c*) and (6*d*) same as the FIG. 6 to FIG. 10, the lens surface has desired treatment including sand-blaster, or prism. or white pigment(s) while injection, or other textures, or marking, or opaque-lens, or painting, or add white color, or design, or arts; to make the narrow emit-out LED light beams to passing through and make a whole big-area of 2nd optics-lens, 2nd lens, housing for desire or preferred one of even brightness illumination.

The optics-lens (400) is not same as co-inventor US patent Prior arts "U.S. Pat. No. 7,632,004 issued date on Dec. 15, 2009 which is U.S. application Ser. No. 11/806,284 filed on May 31, 2007 Publication Ser. No. 2008/0304 289 Publication date on Dec. 11, 2008 for (#Q-07) LED night light with more than one optic element(s)".

However, the said optics-lens or housing (6*c*) (6*d*) LED illumination or light effects can copy the parent filed case (#Q-07) that have 1st optic-element in different length or even a flat piece to protect people touch LED body or make below more than one or plurality of narrow LED light beam go through or spread to wider angle, to let the LED beam passing through the 1st optics-element and emit to the 2nd optic-element to make the light-beam go through multiple times at least one or any combination of reflection, refraction, diffusing, so can become even brightness on whole surface of 2nd optics-element to be seem on whole surface of the optics-lens (6*c*) (6*d*). This is same as above detail discussed of light-beam traveling path (6*f*) (6*f*) (6*f'*) of FIG. 6. It is appreciated the said 1st optic-element (6La) and 2nd optics-lens (6*c*) (6*d*) is same as the parent filed concept with upgrade or improvement to change the linear 1st optics-lens become short length even a lower dome or flat piece and keep same purpose (1) prevent people touch LED body and (2) wider the LED narrow angle to wider angle (3) Allow the plurality of LEDs can go though and not from parent tube or cone only can allow one LED fit under. The current invention also shown one of preferred embodiment without limitation for details light beam travel path (6*f*) (6*f*) (6*f'*) to show how to make the one or more LED light source to create a sealed or open back housing to form the evenly brightness and big area or surface light performance.

From the FIG. 6, the 2nd optics-lens or 2nd lens or housing (6*c*) or (6*d*) is not a solid circle or tube or arc or donut piece and it is an injection-piece to save plastic-expensive cost but can spread-out LED light-beam to whole or big-size surface basing on the details LED light-beam traveling path (6*f*) (6*f'*)(6*f'*) and all LED(s) is emit to same direction and emit into the same or adjacent area(s) basing each location of LED of more than one LED(s) which is covered by the co-inventors (#H-05) idea and concept which has its parent filed case back to 2003.

From FIG. 6 can see more than one of LED (having 2nd LEDs) how the said each narrow emit-out light beam all emit to same direction and go through the 1st flat optic-lens or 1st protect lens and emit to 2nd optics-lens or 2nd lens or housing light transmitting-area(s) (6*c*) (6*d*) and spread out to wider areas as FIG. 6 (6*f*) (6*f'*) (6*f'*) and emit out from FIG. 7 shape hole (7*b*).

From FIG. 6 show the LED night light (6) have the more than one LEDs (including the 2nd LED) fit within the lower position to make the LED light-beam emit through 1st optics-lens (here prefer is at one of or combination of protect piece, diffusor piece, reflective and refractive piece) and emit to top or walls of the 2nd optic-element (6*c*)(6*d*) inner space and make multiple reflection and/or refraction to make even brightness illumination and LED night light incorporate IC and preferred switch to create desired light performance with color-changing, color-selection, functions change trigger by select-switch, or photo sensor and motion sensor to trigger the LED(s) for desired illumination. This is the No. 5 features of current and parent filed case to have sensor-assembly to trigger the LED night light which is not existing before 2004 when the parent case filed date.

Further, the said LED night light have the built-in additional functions including above said motion and photo sensor, but also have built-in rechargeable battery (7*e*) (26) and USB-ports (7M) for power failed time to turn on the top power fail light (6*j*) located on the top of housing (6*e*) and power fail light area is separated with night light illumination areas (6*c*) (6*d*). This arrangement for more than one LED light source having 1st light source to offer light to light-transmitting-area(s) and 2nd light source have 2nd light source to emit light to window or opening or light passable area(s) that is fall within the claim coverage of the co-inventor parent filed case Multiple light source Night light which is U.S. patent application Ser. No. 11/255,981, filed Oct. 24, 2005, now is U.S. Pat. No. 7,455,444 issued on Nov. 25, 2008 which is CIP of parent filed case of Ser. No. 10/884,747 and other parent filed case(s).

The said LED night light also have optional or preferred more additional-functions as other sensor such as sound/moving/radar (microwave) sensor (6*i*), sonic repelled device (6*k*) to bug, mouse, or mosquito-high-voltage-terminator device (6*k*), surge/over-heat/over-load/over-charge/short-circuit protector circuit (6*g*), recharge battery (6*h*) for power failed time power source, or battery (6*h*) for power bank for built-in USB-export-port (not shown). This is No. 7 of the current invention for multiple functions one of exemplary embodiment(s).

From FIG. 7 show the LED night light have built-in AC-to-DC or other preferred circuit to get AC power-source to change to DC current for inside LED(s) to offer the desired functions for big-area illumination (7*b*). And, The LED night light have preferred second or more additional functions including the (1) wireless receiver and/or transmitter device (7*h*) (7*i*) including IR/RF/Blue-tooth/Z-way/Zig-Bee/Wi-fi to work with download APP software for desired wireless control, communication, operation, or (2) USB-charging or be-charge port(s) in Type A, Type C, Micro-USB, Mini-USB or other types available from market place with rechargeable or regular ALKLINE battery (6*h*), (3) sensors including CDS (7*j*) or PIR motion sensor (9*g*) or other preferred sensor (6*i*) or selected-switch or slide-switch with multiple-sections for selection of desired auto color changing, freeze color, function selection, brightness selection, color from multiple of colors from one of the said LED plug-in night light.

From FIG. 8 show the $2^{nd}$ optics-lens or $2^{nd}$ lens or housing (8*g*) is one of housing have preferred even or variable thickness for substrate and has preferred textures or marking or printing or painting or arts or cartoon character shape or optics-designs with or without preferred openings, windows, cut-out of geometric shape of the said $2^{nd}$ optics-lens or $2^{nd}$ lens or housing (8*g*) having at least one surface such as one preferred embodiment optics lens (8*g*) have at least or more pre-designed windows or areas (8*f*) (8*e*). The said $2^{nd}$ optics-lens or $2^{nd}$ lens or housing (8*g*) has more than one LED (6L) and $1^{st}$ lens (6La) and $2^{nd}$ lens (8*g*) but the housing (8*g*) the back is open without sealed so light beam also can emit to the wall where the prong plug-into wall.

The said LED night light (8) has preferred at least one additional-function such as (1) wire-arrangement glove, ditch, holder, racket, poles, stands (8*j*), (2) USB charging or input ports(s) (8*h*) (8*i*) for desired type including Type A, B, C, D or micro-USB ports for (2-1) charging outside be-charged products or (2-2) charging built-in rechargeable battery while the prong plug-in AC outlet power-source.

The USB ports (8*h*) (8*i*) also can be an export-port to charge other products while the prong is not plugged so the LED night light became a Power-Bank to charge other be-charged products and power is from built-in rechargeable or regular alkaline battery with proper pre-designed charging circuit. It is appreciated while the LED night light lost AC power source, the rechargeable battery (6*h*) also supply power to the other location LED(s) to turn on for power failure light (6*j*). This is the No. 8 important features of current and parent filed case.

From the FIG. 9 show the big area illumination (9*a*) which change from the narrow emit-out LED light passing through the front $1^{st}$ and $2^{nd}$ optics-lens (9*a*) or-and optic-lens side-area (9*b*) or-and optic-lens side-area (9*c*) to become wider spread-out light-beam to make wider-area can see the pre-determined illumination. Hereof, the said optics-lens can be any geometric shape including cartoon or movie or character shape, construction, size, thickness and treatment for optics-properties with or without openings, shape holes, cutouts with or without painting, printing, art, design on the surface to get desired even brightness with IC circuit and/or select-switch to create and get desired functions and the preferred color changing, color selection, function selection with preferred adjustable color or brightness or both. The light performance including (a) have even brightness on surface and/or (b) have light-beams emit out from at least one of the light passable area(s), light transmitting area(s), opening(s), shape-cutout(s), hole(s), window(s) (which is not punch through) (c) or both (a)+(b).

The said added second or more function is AC outlet ports (9*d*) (9*e*) (9*f*) or USB-ports (not shown). The said 3 port(s) or outlet receiving-end(s) (9*d*) (9*e*) (9*f*) is one of 3 prongs AC outlets or 2 USB-port(s)(9*e*) (9*e*) and 1 audio input-port (9*f*) to allow other electric-device 3 male-prongs or USB male-plug or audio-wire male plug to insert similar but up-grade with FIG. 1 to FIG. 5 shown or without ground-pin or is a foldable prong-device. While the said 3 ports is AC outlet ports (9*d*) (9*e*) (9*f*) or USB ports (9*d*) (9*e*) or other adaptor-hole (9*f*) such as audio-input port, also can be any other second functions circuit or ports or receiving-end or slots as above discussed (i) to (xxi) 21 preferred second or more electric additional-functions.

These are limited exemplary of the said second or more additional functions but should not limed for all the said additional functions added-to the said simple LED illumination from the first or the said primary LED light source of LED night light. It is appreciated the current invention claim coverage should cover all functions of above listed 21 exemplary items but without any limitation for any other additional function(s) including the said add the IC control the said color changing functions, color selection by switch, functions selection from motion or non-motion or other selections.

All these add functional IC, electric-parts, switch, all kind of sensor to increase the functions all should belong to current invention said additional function(s). The said current invention is continuously or division filing case basing on the above filing history basing on 2005 and the 2005 is the $1^{st}$ year had white color LED applied to the said night light and market even think simple one LED illumination night light and built-in extra circuit is too expensive than incandescent bulb, so except the co-inventor filed on 2005 for LED light with preferred additional function(s).

None of other patent filed to add additional functions top of the one LED illumination night light that have just one LED illumination light effect with manual or CDS switch to turn on and turn off LEDs for illumination. Further, the co-inventor is $1^{st}$ one to file the LED night light has more than one LED light source as above discussed (#H-2005) and (#H-1) issued patents. Also, the co-inventor is $1^{st}$ one to file the LED night light has more than one optics-elements which the LED light source have one top $1^{st}$ optic-elements with different height or flat lens to prevent people touch the LED light source(s) and/or wider the narrow angle LED light source emit angle as above discussed co-inventor (#Q-2007) parent filed case.

The (#Q-2007) have not only the $1^{st}$ optics-element but also have a $2^{nd}$ detachable, replaceable, changeable optics-element fit into base glove or ditch or gap for tighten fixed on the said LED light base as above discussed filed history (#Q-2007).

Because all the market items before the co-inventor filed (#Q-2007) all the items the white color LED(s) is directly exposure and people can touch the LED(s) directly without any $1^{st}$ optic-element to cover it and the $2^{nd}$ optic-element is not sealed piece and wall side is open without any housing parts or lens or plastic so all market items is not safety and not same as co-inventor (#Q-2007) case stated having at least one $1^{st}$ optics-elements in geometric shape to cover the lower LEDs to prevent from directly touch lower positioned LED(s). This is reason why co-inventor can get the patent issued.

So, the current invention still has right to claims the same concepts for both

1. "more than one LED light source emit out from different areas or windows or body of said LED light as parent filed case (#H-2005) U.S. Pat. No. 7,455,444 and (#H-1)".

The current invention has big improvement for update technical and skill as below listed (3) exemplary discussion;

1-1 A multiple function LED night light, comprising;

At least two LED light source sets including first and second light sources light beam emit to different locations selected from the group consisting of openings, windows, holes, cut-outs, and light-transmitting areas of LED light housing.

Wherein the first LED light source set supplies the light beam to LED light fixed, detachable, changeable, replaceable light-transmitting areas selected from the group consisting of a lens, optic-lens, front cover, solid plastic piece, plastic injection unit(s), and cartoon character shape cover with or without the decorative design, arts, painting, printing, injected colors, to provide expected light effects, and Wherein the second LED light source set supplies light beams or illumination to the viewer through said opening(s), window(s) (not punch through), holes, cut-out and the said light-transmitting area(s) where is different area for first light beam emit to.

1-2: A multiple function LED night light, comprising;

At least two LED light source sets installed within a housing,

Wherein said two of LED light source sets include first and second light set, both are LEDs light sources.

The improvement wherein;

The first and second LED light source set emit preferred color(s) light beam to viewers while the prong connect to AC house power source.

The LED light further comprising light-transmitting parts of housing to make said night light have a valuable appearance and selected from the group consisting of any combination of a solid plastic injection piece, a texture lens, an injection cover, an injection cartoon character cover with preferred art, design, painting, printing, injection-color with cut-out(s), shape-hole(s), opening(s).

Wherein, the First LED light source set emit single color light beam and the second LED light source set emit the multiple color light beam to make desired light show with desired color-changing or multiple colors light effects while incorporate with IC, and At least one of additional function is at least one switch or trigger-combination including desired combination of photo, motion, moving, radar sensor(s) to get at least one of desired light effects or function including (1) select or freeze preferred color, (2) select the light show including fade-in & fade-out, chasing, sequential or other light show available from market, (3) function selection between motion sensor or none motion sensor activate the light function(s), (4) select the brightness, (5) other setting, adjustable, selection, changing of LED related functions.

1-3 A multiple function LED night light, comprising;

At least one LED;

At least a first optic-element and a second optic-element for transmitting light beam from said LED Wherein the 1st optic-element is a low-height dome lens, or a flat lens, or a refractive optic-lens fit within the night light base top opening to cause the lower position at least one colorful LED(s) or LED set(s) light-beam travel or refracted through and emit to the $2^{nd}$ optic-element.

At least one of $2^{nd}$ optic-element has geometric shape at least including cartoon or character shape with preferred light-transmitting capability with or without shape-hole(s), opening(s), cut-out(s) to show the different light color, brightness, effects while the LED light beam emit out from $1^{st}$ optic-element and go through $2^{nd}$ optic-element different area(s);

Wherein $2^{nd}$ optic-element different area(s) including (1) opening(s) area, (2) opaque or low light transmitting capability area(s), (3) high light transmitting capability, and At least one of additional switch to get at least one of desired LED light effects or function including (1) select or freeze preferred color, (2) select the light show including fade-in & fade-out, chasing, sequential or other light show available from market, (3) function selection between motion sensor or none motion sensor activate the light function(s), (4) select the brightness, (5) other setting, adjustable, selection, changing of LED related functions.

and

2. "More than one optic-element(s) for LED night light as parent filed case (#Q-2007)".

The current invention has big improvement for update technical and skill as below listed (2) exemplary discussion;

2-1; A multiple function LED night light, comprising;

At least one of LEDs built-in the night light housing incorporate circuit changing house AC to desire DC and IC for preferred LED illumination(s), and At least one of motion or radar and photo sensor system or trigger-device; to turn on and turn off the said LED(s) for pre-determined LED light effects that at least including one or more of (i) area illumination, (ii) color changing, (iii) color selection, (iv) light show change, (v) motion or non-motion function selection, (vi) brightness adjustable, (vii) wake-up or sleep LED light function, (viii) power failure light, (ix) flashlight, (x) emergency light; while LED light has AC power or lose AC power, and, and At least one of addition function is USB charging-circuit and USB-port(s) installed within the LED night light housing to cause the LED to illuminate and charge other be-charged products.

2-2: A multiple function LED night light, comprising;

At least one of LEDs built-in the night light housing incorporate circuit changing house AC to desire DC and IC for preferred LED illumination(s), and At least one of photo sensor or trigger-device; to turn on and turn off the said at least one LED(s) for pre-determined LED light effects including at least one or more of illumination (i) for area, (ii) with color changing function, (iii) with color selection, (iv) with changeable light show, (v) with motion or non-motion function selection, (vi) with brightness adjustable, (vii) with wake-up or sleep LED light function, (viii) for power failure light, (ix) flashlight, emergency light; while LED light has AC power or lose AC power, and At least addition function is at least one switch built-in housing to allow people to make selection of preferred light show, light performance, light color, functions, brightness.

From FIG. 10 show the preferred embodiment (10) LED night light has optic-lens (10*a*) (10*b*) (10*c*) which has desired texture, painting, color, printing, arts, design, geometric shape including cartoon or character shape, opening(s), shape-cutout(s), window(s) (not punch through), or has desired optics treatments or optics properties to make desired areas, opening(s), shape-hole(s) has illumination and/or light-beam emit out from inner LED or LED(s) with desired IC and/or circuitry to make desired light-show including color changing, color selection, brightness adjustment, function selection by at least one of switch, sensor, sensor combination.

The LED night light (104) have preferable additional-functions may select from;

10-1. Time/temperature/timer/weather display (10*e*), or 10-2. Surge/over-charge/over-heat/short-circuit/other protective circuit or device (10*f*)

10-3. USB ports for charging other outside be-charged products or charge built-in rechargeable battery and USB-ports is one of Type A, C or micro-USB or other type of USB-port (10*e*).

10-4. Outlet device (10*d*)

Figure 17A:
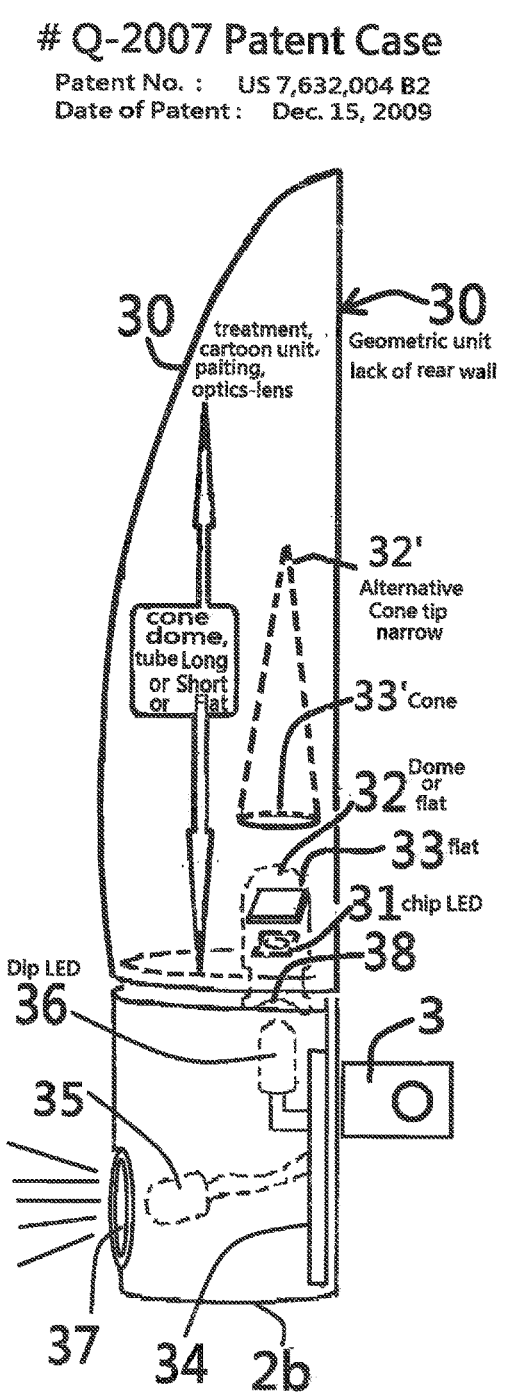
Figure 17B:
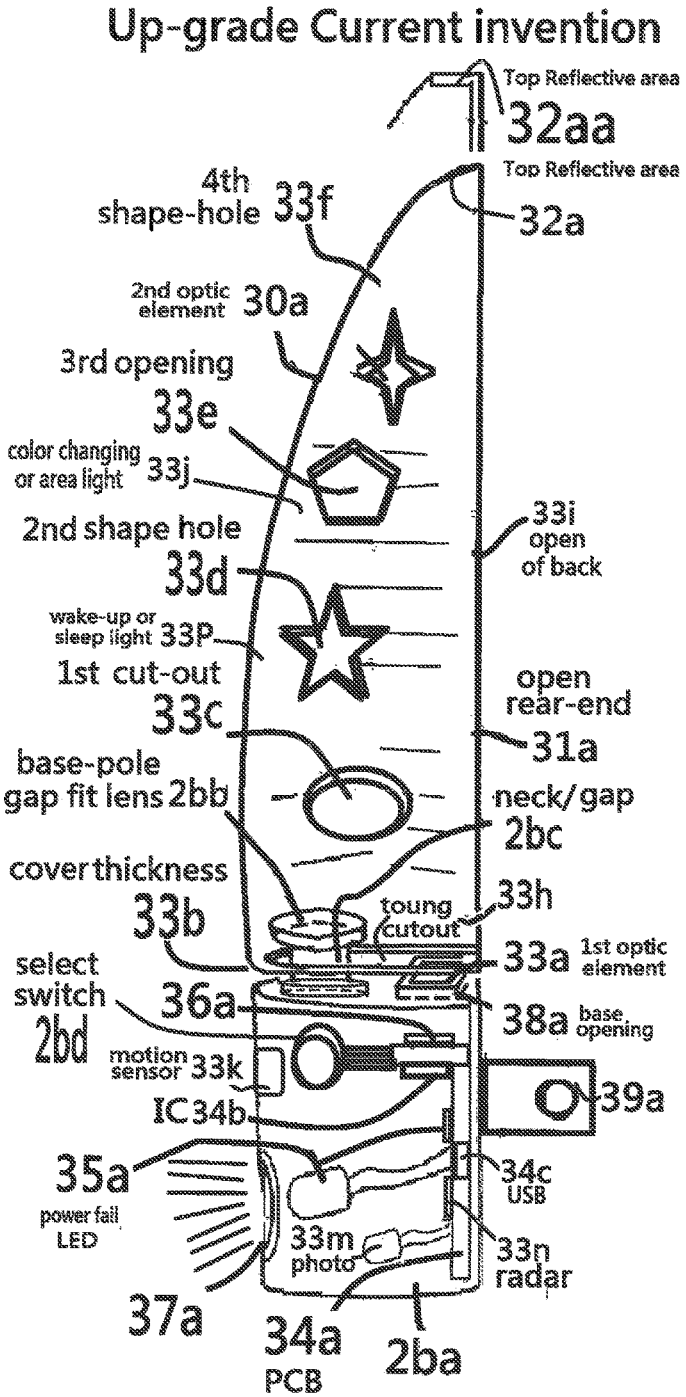

10-5 LED light $1^{st}$ optic-lens or $1^{st}$ lens (6La) and $2^{nd}$ optic-lens or $2^{nd}$ lens ($\mathbf{10}_a$) (10*b*) (10*c*) has desired texture, painting, color, printing, arts, design, geometric shape including cartoon or character shape, opening(s), shape-cutout(s), window(s) (not punch through), or has desired optics treatments or optics properties to make desired areas, opening(s), shape-hole(s) has illumination and/or light-beam emit out from inner LED or LED(s) (6L) and can cross reference the FIG. 17B for shape cut-out (33*c*), shape hold (33*d*), openings (33*e*), shape hole(s) (33*f*) and the said $2^{nd}$ optic-element (30*a*) is one of geometric shape including cartoon or character shape and base has desire thickness with tong shape cutout or U or circle or sphere or other preferred cutout (33*h*).

And, the tong shape cutout (33*h*) to tightly join with the neck or gap (2*bc*) of top-pole (2*bb*) of base-pole (2*ba*). Also, the base has base-opening (38*a*) to fit the $1^{st}$ optic-lens or $1^{st}$ lens (6La) or $1^{st}$ optic-element (33*a*) which protect people to touch LED unit and/or wider the lower position LED (36*a*) emit angle to wider areas and emit to the $2^{nd}$ optic-lens or $2^{nd}$ lens or $2^{nd}$ optic-element (30*a*) to make the light beam to glow the $2^{nd}$ optic-lens or $2^{nd}$ lens or $2^{nd}$ optics-element (30*a*) which is one of geometric-shape or cartoon shape (not shown) or character shape (not shown) and some light beam emit out from the shape cut-out (33*c*) or shape-hole (33*d*) or opening(s) (33*e*) or shape-hole(s) (33*f*). The said $2^{nd}$ optic-lens or $2^{nd}$ lens or $2^{nd}$ optic-element (30*a*) has base with thickness to fit into the gap (26*c*) of base-pole (2*bb*) tightly by the tong-cutout (33*h*) and the $2^{nd}$ optic-element (30*a*) is open rear-end and light can emit to the wall too.

FIG. 11 shows a multiple function LED night light (11), in which the additional or $2^{nd}$ or more function (801) can be selected from the group including any as above and below discussed (i) to (xv) 15 examples for the second or more additional-functions list but not limited for these 21 examples of second or more functions, or-and; as disclosed in co-pending U.S. patent application Ser. Nos. 1/527,631; 11/527,629; 11/498,881; 11/498,874; and 11/527,628 etc., of an air freshener, adaptor or female receiving-end(s) or female port(s) device, sonic device, frequency device, bug repelled device, second LED or more LED(s) light device, timepiece, electric message device, timer device, temperature device, surge protection device, electric short circuit protection device, motion sensor, power fail light, flash light, additional switch to make color selection functions, addition switch to make selection preferred function from motion or non-motion, base device for installation on an existing lamp socket, emergency light device, or any other electric device(s) suitable for home use to keep people comfortable or safe.

From FIG. 12 also shows a multiple function LED night light (12) whose added or $2^{nd}$ or more additional functions is one bug or mosquito high-voltage device (803) which having proper high-voltage multiple-level nets (803) on surface and the terminator will burn the bug or flier or bad-flying-bug while touch the multiple-level net (803).

From FIG. 13 shows a multiple function LED night light is a special LED bulb (13) is assembled in the existing or out-of-date incandescent-bulb night light base (13') for additional-function. The multiple function LED night light of FIG. 13 has at least one LED-bulb (13) is built-in or add-on to installed on a geometric base that already have different type for mechanical toggle switch or electric photo-sensor as switch to turn on and turn off the light source.

The LED night-light has a bulb receiving-socket (80) to accept the conventional bulb base (81), which may select from a screw type (81), pin type (not shown), rivet type (not shown), or knob type (not shown). The LED-bulb (13) has its own built-in circuit to change the original LED-light prong input-end AC electric signal to an LED's DC electric current while the LED bulb base (81) assembled with receiving-socket (80). The, the LED bulb (13) turn-on the LED(s) to exhibit predetermined function, duration, time, and/or brightness and light effects by switch or by desire combination for photo, motion, moving, radar sensor(s) built-in the said LED bulb housing or LED night light housing.

As shown in FIG. 13, the LED night-light base (13') has a female bulb socket (80). And, the said additional-function provided by the outlet-ports (3000) (3000') (3100) to offer electricity to other electric product(s) while the prong (3200) (3200') are plug-into the outlet power-source.

At the same time, while prong (3200) (3200') are connected with the wall outlet AC power source, the bulb socket (80) also will receive the wall outlet AC power source electric signal, which in the USA is house electricity around 110 Volt, 60 Hz to turn on the said built-in or added-on LED bulb.

On the other hand, specially designed LED bulb device (13) has a built-in circuit to change the wall outlet power source of 110V AC, 60 Hz to the working voltage and frequency of the circuit and LED(s) with desired control-kits such as a photo sensor, PIR sensor, manual switch, or other control available in the marketplace to turn on LED(s) according to pre-determined functions, brightness, duration, and time.

The LED bulb (13) fits into or built-into or assembled with the bulb socket (80). The LED bulb (13) has a screw-thread base (81) may be but is not limited to a screw type base as shown in FIG. 13. The bulb-base (81) has two electric terminals (83) and (82) to connect with LED night-light base (80) inner circuit electrodes (not shown) and through the electrodes to connected with a prong (3200) (3200').

The AC from the LED-Bulb (13) base outside two electric contactors (83) (82) supply LED-bulb (13) inner circuit-board (81') and changes AC from home appliance electric current to LED working DC and turns on LEDs (85) for single color or multiple colors to provide a desired light performance. The LED (85) is located on circuit board (81') and connected with circuitry (81') and circuitry connect with the bulb-base electric-terminals (82) (83) by conventional conductive-piece in circuit board (81'). The electric components (88) (85) installed on the circuit board (81') or connected by conductive-piece (87) (84) away from the circuit board (81') because some components may be too big and unable to fit within the bulb base (81). The circuit board (81') is a narrow elongate board inserted into the bulb base (81), which is different with the prior art U.S. Pat. No. 6,227,679 (Zhang et al.) issued on May 8, 2001. The Zhang discloses a circuit board located on the top of the base, in a vertical relation to the circuit board and base. Also, in the arrangement of Zhang, the LEDs are not located on one side of the circuit board but rather are applied on the circuit board with a certain angle to the circuit board surface. This is because Zhang does not realize that the distance between the LED tip and the top cover is way too close and it is impossible to eliminate the spot-light problem of an LED light beam therefore does not get a good light performance on the bulb surface. The current invention uses the invention described in one of the co-pending applications listed above, of an LED night light with more than one optic-lens, to make the spot-light beam into an area-light by first optics-lens. By adding a second optics-lens, the light beams brightness will be very close at every point on the desired area or surface.

As shown in FIG. 13, LED (85) on is situated on the edge of the circuit board (81') and positioned such that light beams from the LED are input to the first optics-lens (89) to cause the light beams to travel within the first optics-lens (89). The top may use a dome shape design or a "V" shape design to collect light beams that hit the top area of the first optics-lens. It will be appreciated that all equivalent treatments such as metallization of the top area or adding reflective arrangements within the first optics medium will be still fall within the scope of the invention. The LED device (13*b*) with screw type base can fit into a bulb night light's base socket (80) to replace the bulb and let the existing bulb night light become an LED night light without having to purchase a brand-new unit to save money and change the big power consumption device into a lower power consumption device in seconds.

This arrangement solves the problem with the arrangement disclosed in the Zhang patent cited above that there is not enough space in a night light having the most popular dimensions to achieve a good area lighting effect. The most popular night light length is around 88 mm+/−50 mm (with base). The lens height is around 60 mm+/−30 mm (without base). The distance from the wall outlet cover to the highest point of the night light edge is around 35 mm+/−15 mm (from outlet cover surface). If placed in the same location as the existing bulb night light, the distance from the bulb socket to the wall outlet surface will be less than 35 mm. This distance from the wall to outside of the lens will only be less than 35 mm+/−15 mm. It is too short to change the spot-light effect of the LEDs into a surface or area lighting effect.

Hereof, The Multiple functions LED night light have LED illumination function and also have at least one of below list additional-functions including:

(1) air freshener, fragrance refill piece, liquid or wax fragrance or de-order piece as [FIG. 3 (25)]

(2) adaptor/USB-port(s) FIG. 2 (22*b*) (22*c*)/Outlet(s) FIG. 1 (20), FIG. 2 (20*a*)/Audio output or receiving port or other ports(s) FIG. 7 (7M)/memory receiving slot(s) or USB ports FIG. 8 (8*h*) (8*i*) device as [FIG. 1 (20), FIG. 2 (20*a*) (22*b*) (22*c*), FIG. 7 (7M), FIG. 8 (8*h*) (8*i*), FIG. 9 (9*c*,9*e*,9*l*), FIG. 10 (10*d*) (10*e*)], (3) sonic repelled FIG. 6 (6*k*)/mouse repelled FIG. 12 (803)/mosquito high-voltage shock or terminator FIG. 12 (803) device, [FIG. 11 (801), FIG. 12 (803)]

(4) frequency/wireless transmitting FIG. 7 (7*i*) and/or receiving FIG. 7 (7*h*)/blue-tooth FIG. 7 (7*n*)/Z-way FIG. 7 (7*n*)/ZigBee FIG. 7 (7*n*)/IR FIG. 7 (7*n*)/RF remote control FIG. 7 (7*n*)/wi-fi FIG. 7 (7*n*)/router/APP download software/internet/3.4.5G network device [FIG. 7 (7*h*) (7*i*)], (5) bug repelled device FIG. 11 (801) [FIG. 6 (6K)], (6) Second or power fail FIG. 6 (6*j*), or emergency light FIG. 9 (9*j*) or other 2nd light FIG. 9 (9*i*) device as [FIG. 5 LEDs (60) (70), FIG. 4 LED (01), FIG. 9 power fail/emergency LED light source (9*i*) (9*j*)], (7) USB port FIG. 8 (8*h*) (8*i*) for input power for internal battery FIG. 7(7*k*) or for output for charging other be-charge device with Micro-USB, Type A FIG. 2 (22*a*), Type C FIG. 2 (22*b*) or preferred USB ports [FIG. 2 (22*a*) (22*b*)], (8) electric message device FIG. 7 (7*h*) (7*i*) as [FIG. 7 (7*h*) (7*i*) for wireless transmitter and/or receiver], (9) timer FIG. 10 (10*e*)/temperature FIG. 10 (10*e*)/timepiece FIG. 19 (10*e*)/device [FIG. 10 (10*e*)],

(10) power-bank FIG. 7 (7*k*) having USB port FIG. 7 (7M) and rechargeable battery FIG. 7 (7*e*) device [FIG. 7 (7*e*) (7M)],

(11) surge protection FIG. 6 (6*g*) FIG. 10 (10*f*) device [FIG. 10 (10*f*), FIG. 6 (6*g*)],

(12) electric short circuit protection FIG. 10 (10*f*) device [FIG. 10 (10*f*), FIG. 6 (6*g*)],

(13) base device FIG. 13 (13') for installation on an existing lamp socket FIG. 13 (80) as [FIG. 13 (13') or FIG. 13A (13")],

(14) emergency FIG. 9 (9*j*)/power fail light FIG. 6 (6*j*) device as [FIG. 9 (9K) (9*i*) (9*j*) (9*h*)] [FIG. 6 (6*j*)], or

(15) wire-arrangement FIG. 8 (8*j*) FIG. 3 (23) for LED night light have USB-port FIG. 1 (22), FIG. 2 (11*a*) (22*b*), FIG. 3 (23), FIG. 8 (8*j*) slot FIG. 3 (23), groove FIG. 8 (8*j*), ditch FIG. 8 (8*j*) as [FIG. 3 (23), FIG. 8 (8*j*), FIG. 3 (23), FIG. 8 (8*j*)]

(16) Audio FIG. 3 (24)/sound FIG. 3 (24)/music device FIG. 3 (24) by pre-record or memory-units FIG. 7 (7M) or blue-tooth FIG. 7 (7*h*) or wi-fi FIG. 7 (7*h*) connection as [FIG. 3 (24)]

(17) a camera FIG. 7 (7N) and/or a wireless communication FIG. 7 (7*h*) device the data storage FIG. 7 (7M) device is a memory unit, SD card, micro SD card, to enable a photo, video, or sound to be saved into the data storage device and/or wireless transmitted or communicated to another electric device as [FIG. 7 (7N)].

(18) Motion sensor FIG. 1 (28), FIG. 9 (9*g*), photos sensor FIG. 7 (7*j*) or other moving, radar sensor(s) FIG. 1 (28), FIG. 9 (9*g*), FIG. 7 (7*j*), wireless controller FIG. 7 (7*h*), IR or RF remote controller system FIG. 7 (7*i*) can activate the said LED illumination for hand-free or by remote-controller for walk-free. These additional functions made by built-in circuit or IC to create multiple functions which is much better than co-inventor's parent filed cases since 2004 when the white LED light just present at market place. These additional function beside the simple LED illumination for just On-Off is the important features of current invention filed from 2004 and these additional functions is good to keep people comfortable or safe. The added function(s) may be one to N (any number) to make a very practical multiple functions LED night light.

Figure 14:
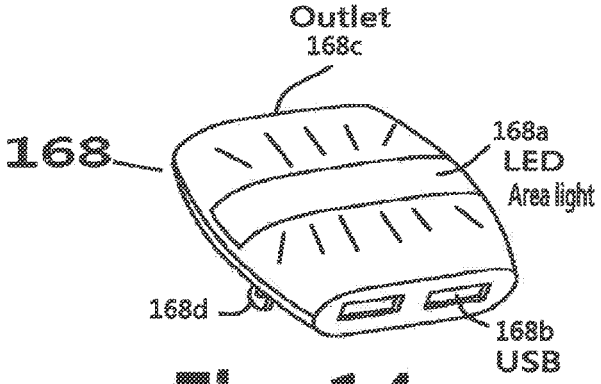

From the FIG. 14 show the Plug-in LED light (168) has belly illumination (168*a*) for area illumination and the alternative design for this illumination also can arrange on back of the LED light. And, the plug in LED light have 2 USB port (168*b*) and desire number of AC-outlet receiving ports (168*c*) and AC power source input LED light (168) by foldable or fixed position prong (168*d*).

Figure 14A:
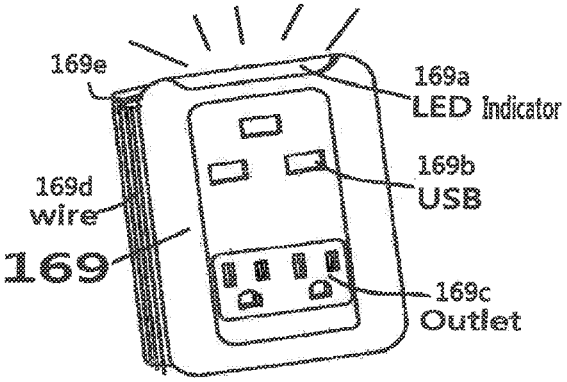

FIG. 14A show the Plug-in LED light (169) has top LED illumination (169*a*) for show the charging-status and/or power status with built-in 3 USB port (169*b*) and 2 AC outlet-port(s) (169*c*) with wire-arrangement kits which may is groove, ditch, holder, foldable poles, press-tight wire device to coil the wire including separated USB-wire or other USB related wire along the contour or edge wall of the said LED plug-in night light.

Figure 14B:
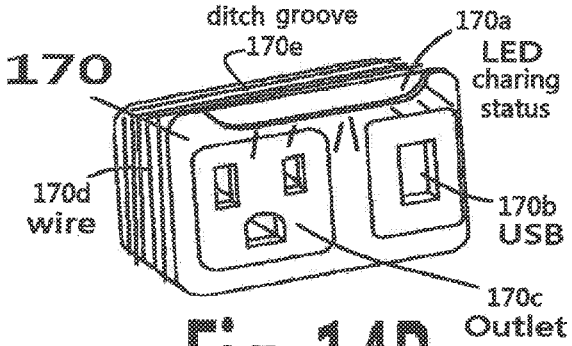

From FIG. 14B show the Plug-in LED light (170) has top LED illumination (170*a*) for show the charging status and power status with built-in 1 USB port (170*b*) and 1 Outlet port (170*c*) with or without the wire arrangement kits same as the above discussed type and models and applications.

Figure 14C:
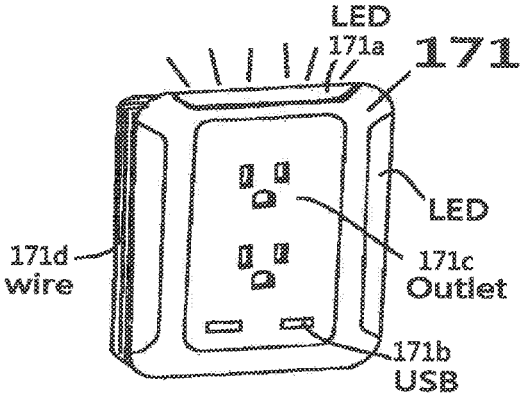

From FIG. 14C show the plug-in LED light (171) have top indicator light and sides area light and bottom area light so total has 4 area(s) LED illumination with desired color changing, multiple color, color selection, functions select switch(s). Wherein, LED light (171) has built-in 2 USB ports (171*b*) and 2 outlet port (171*c*) with wire-arrangement kits by pole or foldable holder or gap or ditch or ditch with wire holder and/or plug holder kits by cut-out of the housing so can fix the wire within the cutout(s) to prevent wire loosen.

Figure 14D:
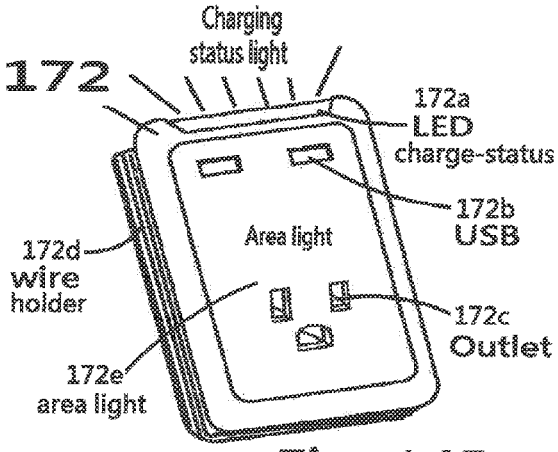

From FIG. 14D show the Plug-in LED light (172) has top LED illumination which may be at least one of power fail light or emergency light or flashlight, or charging-status or power status of LED light (172*a*) with 2 USB port (172*b*) and one of outlet-unit (172*c*) with or without the wire arrangement kits same as FIG. 14A discussed may including the USB-wire male plug holding design too.

Figure 14E:
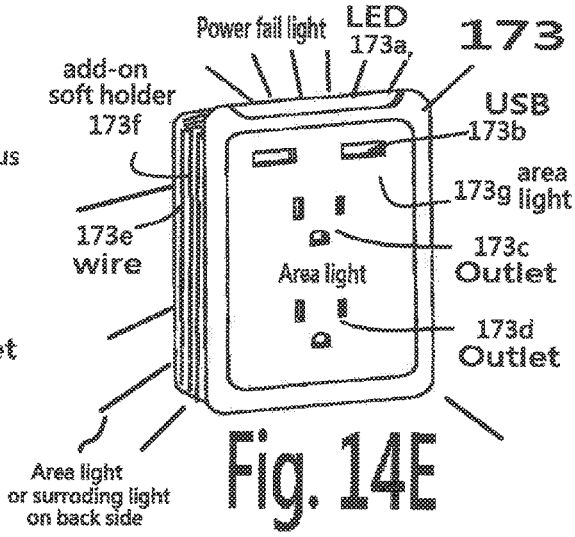

From FIG. 14E show the plug-in LED light (173) has top LED illumination which may be at least one of power fail light or emergency light or flashlight or charging-status or power status LED light (173*a*) with 2 USB ports to share 2.1 Amp up to 10 Amp current and 2 outlet-port(s) (173*c*) and have the added-on soft-material wire-arrangement kits (173*f*) to coil the wire (173*e*). The LED light (173) also have the front surface LED illumination which may be triggered by motion and photo-sensor to emit the desired color-changing with color-selection switch and also may have the functions selection-switch to select the motion activate by motion PIR sensor or dust-to-dawn activated by photo sensor for LED light (173) to turn on the LEDs front surface big area light effects.

Figure 15:
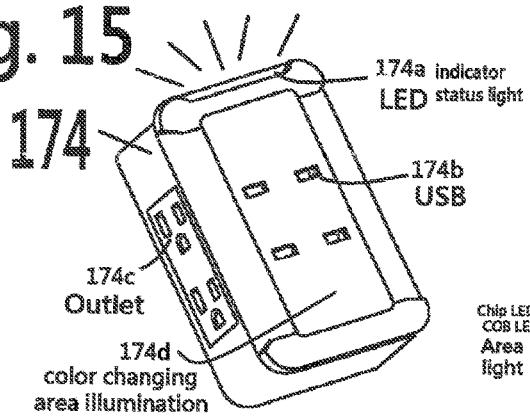

From FIG. 15 shown plug-in LED light (174) has top LED illumination (174*a*) which may be at least one of power fail light or emergency light or flashlight or charging-status or power status of LED light (174) and also have front big surface (174*d*) has color changing area illumination on front or on rear or sides of the LED light housing (174*d*) trigger by motion PIR sensor and photos sensors combination. It also can have select-switch to select the color or select motion activate or dust-to-dawn activated functions. Also, can have the power fail or emergency light or flashlight triggered by AC detector and IC control circuit with ON/Auto/Off function select-switch. The said LED light (174) has built-in more USB-ports (174*b*) which is four and more outlet-port(s) (174*c*) which is also four but the 4 pcs or outlet-ports (174*c*) is put on sides wall of the said LED light (174) housing so can prevent from LED light (173) too thick while plug-into the wall outlets. The said LED top light (174*a*) and LED front big surface light (174*d*) control by inner circuit with IC and/or select-switch to make the desire LED light functions and effects.

Figure 15A:
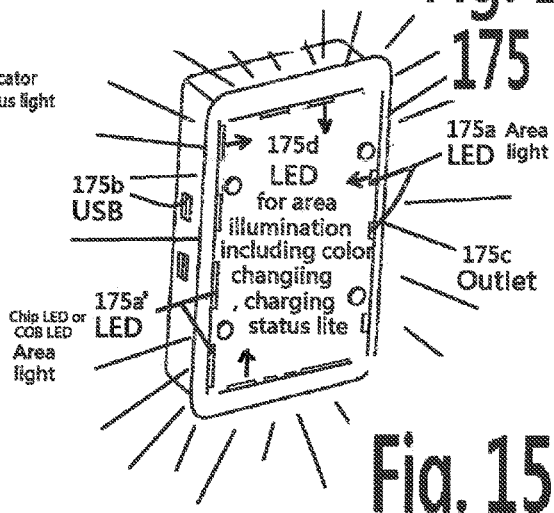
Figure 15B:
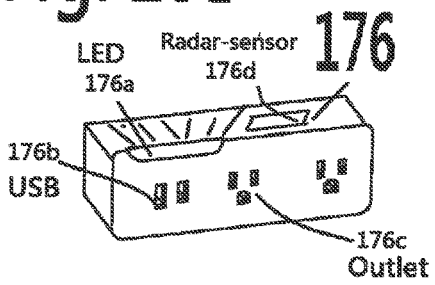
Figure 15C:
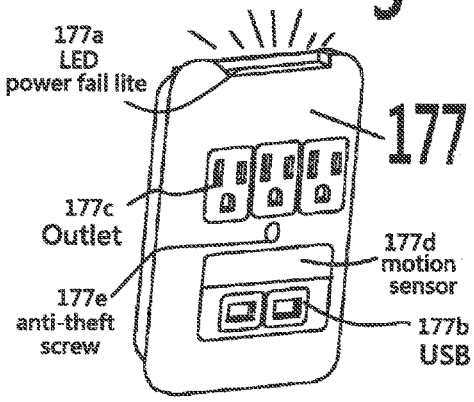

From FIG. 15A show the big front surface with desired LED illumination (175*d*) may is one of multiple or automatically color changing light function control by IC and circuit, and has built-in select-switch to make color selection, function selection light functions and light effects. The light (175) has built-in 4 USB ports (175*b*) and N-number of outlet-ports (175*c*) on side wall and not arrange on front surface to prevent from the male plug too high and interfere the people walking or passing near the wall outlet. It also may have other or $2^{nd}$ LED (175*a*) to show at least one of power fail light or emergency light or flashlight or charging-status or power status of LED light (175). The said area illumination at the big front surface (175*d*) by 4 sides surround PCB and each PCB has built-in number of chip LED(s) (175*a*) or COB LEDs (175') to emit into the center areas so each LED light beam will travel and hit to opposite side white PCB Board or walls to reflect back and forth and some LED light beam refracted front $2^{nd}$ optic-lens or $2^{nd}$ lens or housing lens which has opaque or milky or colored or other texture or treatment or arts to make the front surface emit the desired light performance. The alternative illumination can make on contour walls or the rear side of the said LED light.

From 15B shown the plug-in LED light (176) has the built-in LED (176*a*) for at least one of power fail light or emergency light or flashlight or charging-status or power status of LED light (176) and have one of radar-sensor (176*d*) which can detected the people to turn on only the LED light (176*a*) and the said 2 USB ports (176*b*) and 2 outlet-port (176*c*) is work all the time not controlled by the said radar-sensor (176*d*). The upgrade model is the rear prong can be rotated so can change the LED light (176) from horizon position to vertical position for market requirement. It is appreciated the said prong of the current invention can be at least one of (1) fixed, (2) rotatable angle, (3) rotating orientation of 3 receiving-ports not rotate the prong itself so offer people extra features while many male plugs want to plug-into limited space and block by others.

From 15C is one big LED light (177) which has LED illumination (177*a*) for at least of power fail light or emergency light or flashlight or charging-status or power status or area LED light and also the front big surface also have desired color changing and color selection LED light (177) performance with built-in USB port(s) (177*b*) and Outlet ports (177*c*) and have anti-theft screw hold (177*e*) for people use on public area or hotel areas to prevent people take away. The LED light also may have a front surface area-illumination triggered by the built-in motion PIR sensor (177*d*) and photo sensor assembly so can offer the hand-free night time use illumination from the motion/photo sensor assembly.

Figure 15E:
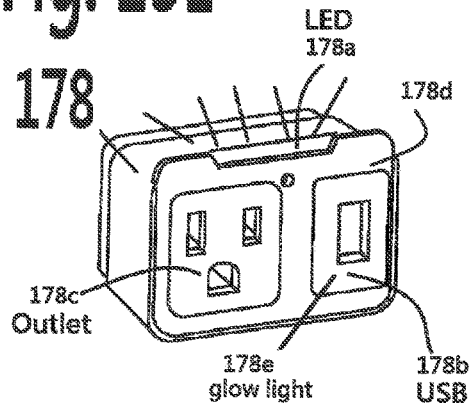
Figure 15D:
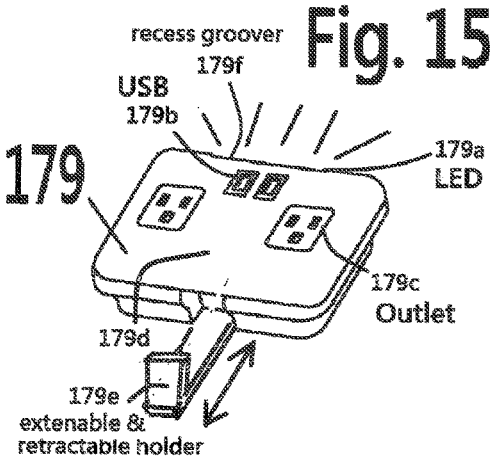

From FIG. 15D is one LED light (179) have top space is recess-groove (179*f*) to allow people can put be-charged items on top of the said LED light. It also may have extended or retractable frame or drawer or hook (179*e*) to hold the be charged items. It is appreciated all the above discussed from FIGS. 14 to FIG. 16E each LED light has flat top area(s) where can install or place be-charge products such as phone or pad device so no need put on the floor. This alternative and upgrade concept is to make foldable frame or extendable/retractable wall, holder, block-walls to make more security storage the be-charged products. The said LED light (179) have the front area (179*d*) have desire LED illumination for preferred light effects as above all discussed skill. The LED light have 2 USB port (179*b*) and 2 outlet ports (179*c*) so can have multiple functions.

From FIG. 15E is one mini LED light (178) same as FIG. 14B only different the FIG. 15E do not have wire arrangement kits but the FIG. 15E have one glow-light (178*e*) surround the one USB-port (178*b*) and one outlet-port (178*c*) with built-in LED (178*a*) for at least one of power fail light or emergency light or flashlight or charging-status or power status or area LED light From FIG. 16 show the LED light (180) have built-in additional select-switch (180*d*) to select functions(s) between the motion or none-motion function(s), freeze color, change light functions. The LED light have foldable prong (180*c*) for travel application. The said LED light (180*a*) offer at least one of power fail light or emergency light or flashlight or charging-status or power status or area LED light or floor light or night light and have built-in USB port (180*b*).

From FIG. 16A is other preferred embodiment of LED light (181) have built-in LED (181*a*) and 2 USB ports (181*b*) one is for output power end Type A USB (181*b*') to charge be-charged products and one is for input power Type C USB (181*b*) to get power from outside DC power source to charge the inner rechargeable battery (181*d*) with travel prong (181*c*). The LED light (181) have built-in back-up battery (181*d*) can be charged while have AC power source and the back-up battery can supply power through Type A to supply power to other be-supplied or be-charged products through Type A as Power bank functions. While LED light (181) is un-plug or AC power lost, the output power USB ports (181*b*') can supply power to the other be-charged products from internal built-in rechargeable battery which should be full charged for long time be charged by AC power from prong while AC power existing. This is different with above discussed for USB port only for output power (181*b*') only while the LED light have AC power source and while LED light is un-plug the USB output port have NO power can supply to other products. Also, this embodiment also has one USB (181*b*) for get power from other device to charge inner rechargeable battery while people bring the travel portable LED light for outdoor for too long time or ran-out all rechargeable battery capacity. The alternative arrangement for Type A (181*b*') and Type C (181*b*) USB-ports both is for output the power because market now have both Type A (181*b*') and Type C (181*b*) separated USB-wire or USB-Power-bank so the light device need both Type A (18*b*') and Type C (181*b*) so can fit all kind of USB-Wire or USB-Power bank.

From FIG. 16B show the replaceable Top Display LED night light (182). The said replaceable or detachable LED display (182*e*) which can present and show color changing or color selection or preferred LED light functions and effects as pre-determined requirement. The detachable or replaceable display (182*e*) be illuminated by lower position multiple piece or multiple color LED(s) (182*a*). The said LED light have base (182) has 2 USB-ports (182*b*) and 2 Outlet-ports (182*c*) and one additional control switch to make the setting, selection, adjusting, changing the said LED light performance or light effects at least one of select the color, change the light color, change LED light functions, change light functions up to tens of selection, adjustment, changings, setting, choice. The detachable or replaceable $2^{nd}$ optics-lens or $2^{nd}$ lens or housing (182*e*) is similar with FIG. 17A (30) and FIG. 17B (30*a*) both also are detachable, replaceable $2^{nd}$ optic-lens or $2^{nd}$ lens or housing but different is FIG. 16B housing (182*e*) is from top and FIGS. 17A (30), 17B (30*a*) is from side to snap-tight with base.

From FIG. 16C shown the LED light (183) have TV-screen front surface (183*d*) and have top (183*e*) and bottom (183*a*) light passable lens for more than 3 light illumination areas (183*a*) (183*d*) (183*e*) and illumination by the at least or more than two of LEDs (183*a*) for these areas. The LED light (183) have the two sides USB port(s) (182*b*) and outlet-port (183*c*). Also, the detachable replaceable housing (182*e*) is one unit insert from top to lower slot so no need the $1^{st}$ optics-lens or $1^{st}$ lens before emitting into housing. However, the said FIG. 17A and FIG. 17B $2^{nd}$ optics-lens or $2^{nd}$ lens or housing (30) (30*a*) both has open-back housing so need the $1^{st}$ optic-lens or $1^{st}$ lens or protect lens to protect people.

From FIG. 16D show the same unit with FIGS. 1, 2, 3, 4 5 so not discuss more details hereafter.

From FIG. 16E sow the LED light (185) have built-in time (185*e*) related functions which may be an analog dial-face or digital time display. The said LEDs (185*a*) offer the dial face or display screen for even brightness. The said LED light has built-in USB port (185*b*) and outlet (185*c*) with travel prong (185*d*). The said time related function has built-in separated or backup DC battery for time related operation or power fail keep time related IC keep working all the time. The said LED light (185) including the time/weather display and at least one of alarm, sound, music, melody sound, wake-up lighting, or sleep night with time count-down features or device to supply the audio function(s). Further, the alarm related function(s) also can offer the wake-up LED accent light before the alarm trigger such as 30 minutes the wake-up accent light glow and continuously to have fixed or color change light or brightness from dime to bright light intensity to wake up the people by lighting effects. It also can offer the Sleeping light with built-in time counter-down with dimmer brightness from high-brightness to lower-brightness within pre-determined time period so can offer kid a sleep count-down LED light effect.

This is No. 9 important featured for current and parent filed case.

From FIG. 17 show the co-inventor current invention parent filed case (#Q-2007) for the LED light have 'more than one of optic-elements" which have details discussion on above FIG. 10 points (10-5) discussion so not discussed hereafter.

LED light optic-lens is $2^{nd}$ optic-lens or $2^{nd}$ lens or housing or $2^{nd}$ optic-element (30*a*) has desired texture, painting, color, printing, arts, design, geometric shape including cartoon or character shape, opening(s) (33*e*), shape-cutout(s) (33*c*), window(s) (not punch through), or has desired optics treatments or optics properties to make desired areas, opening(s) (33*e*), shape-hole(s) (33*f*) has illumination and/or light-beam emit out from inner LED or LED(s) and can cross reference the FIG. 17B. The up-grade of current invention compare with parent filed case at the $1^{st}$ optic-lens or $1^{st}$ lens change from tube (33) or cone (33') shape both has reflective top (32) (32') light beam features to the current lower down even flat shape FIG. 17B (33*a*) because need for more than one piece of LED(s) FIG. 17B (36*a*) to allow the more than one LEDs FIG. 17B (36*a*) light beam can emit through the flat shape $1^{st}$ optics-lens FIG. 17B (33*a*) or $1^{st}$ lens FIG. 17B (33*a*) and the parent filed case which only has one LEDs FIG. 17A (36) so can use tubular (33) or cone (33') shape reflective piece. The current invention has more than one of LEDs FIG. 17B (36*a*) (at least have $2^{nd}$ LEDs) or even plurality of LEDs FIG. 17B (36*a*) for white or color-LEDs so can make the color changing, color selection, chasing, sequential, fade-in and fade-out, gradually brighter and darker effects. So, the current invention made a big improvement to change the tubular (33) or cone (33') with reflective top (32) (32') property for single LED light source (36) to Flat $1^{st}$ optic-lens FIG. 17B (33*a*), $1^{st}$ lens FIG. 17B (33*a*), protect lens FIG. 17B (33*a*) to allow plurality or more than one LEDs FIG. 17B (33*a*) light beam emit through and emit to top areas FIG. 17B (32*a*) or parts FIG. 17B (32*a*) of $2^{nd}$ optic-lens FIG. 17B (30*a*) or $2^{nd}$ lens FIG. 17B (30*a*) or housing FIG. 17B (30*a*) so still get multiple reflection and refraction of LED light-beam to form the even brightness as above discussed on FIG. 3 and FIG. 6 and FIG. 8.

The FIG. 17B has $2^{nd}$ optic-element (30*a*) which have open rear-end (31*a*) and has shape cut-out (33*c*), shape hold (33*d*), openings (33*e*), shape hole(s) (33*f*) and the said $2^{nd}$ optic-element (30*a*) is one of geometric shape including cartoon or character shape and base (33*b*) has desire thickness and tong shape (33*h*) cutout, or U or circle or sphere or other preferred cutout shape (33*h*) to tightly join with the neck or gap (2*bc*) of base-pole (2*bb*) of base (2*ba*). Also, the base (2*ba*) has base-opening (38*a*) to fit the $1^{st}$ optic-element (33*a*) which protect people to touch LED unit (36*a*) and/or wider the lower position one or more than one of LEDs (36*a*) narrow emit angle LED light beam to top reflective areas (32*a*) of $2^{nd}$ optic-element (30*a*) and emit to the $2^{nd}$ optic-element (30*a*) to make the light beam to glow the $2^{nd}$ optics-element (30*a*) which is one of geometric-shape or cartoon shape (not shown) or character shape (not shown) and some light beam emit out from the shape opening(s) (33*e*) or hole(s) (33*f*) or cutout(s) (33*c*). The said $2^{nd}$ optic-element (30*a*) has base with thickness to fit into the gap (26*c*) of base-pole (2*bb*) tightly by the tong-cutout (33*h*) and the $2^{nd}$ optic-element (30*a*) is open rear-end and light can emit to the wall too. The said LED light base (2*ba*) have built-in IC (34*b*) and preferred circuit board (34*a*) which connect with additional select-switch (2*bd*) by wire and circuit (34*a*) have the built-in more than one (at least have one $2^{nd}$ LED) LED (36*a*) and emit the light beam to top opening (38*a*) inner $1^{st}$ optic-element (33*a*) and the $1^{st}$ optic-element (33*a*) light beam emit out to top reflective areas (32*a*) of $2^{nd}$ optic-element (30*a*) and also emit to the rear-open end (31*a*) so can see the light illumination from the front surface of LED light (30*a*) and back wall surface. The light beam emits out from $2^{nd}$ optic-element (30*a*) at least including the $2^{nd}$ optic-element surface and openings or cutout(s) or shape-hole(s) depend on the pre-determined preferred design.

The FIG. 17A is one of above discussed co-inventor parent filed case (#Q-2007) which has tube (33) or cone (33') has top reflective end (32) (32') but only good for 1 LEDs (36) per tube (33) or cone (33') so does not allow to work for more than one LED FIG. 17B (36*a*) for multiple color or color changing functions or hi-low brightness light effects, so the big improvement of current invention shown on the FIG. 17B is upgrade with improvement for the LED plug-in light (30*a*) have additional functions not only for additional select-switch (2*bd*) but also including at least one or more LEDs (36*a*) to make automatically color changing or select color or change hi-low brightness, and only change the tube (33) or cone (33') for only 1 LED (36) to flat $1^{st}$ optic-lens (33*a*) or $1^{st}$ lens (33*a*) or protect lens (33*a*).

This flat shape $1^{st}$ optic-lens or $1^{st}$ lens (33*a*) can allow plurality or more than one LEDs (36*a*) to passing through the flat $1^{st}$ optic-lens (33*a*) or $1^{st}$ lens (33*a*) to create desired light performance, make select color, select functions for character shape of $2^{nd}$ optic-element (30*a*) for whole surface area (30*a*) and/or opening (33*c*) (33*d*) (33*e*) (33*e*) (33*f*) illumination.

The flat $1^{st}$ optic-lens or protect lens (33*a*) improved the tube (33) or cone (33') shape $1^{st}$ optic-element because flat (33*a*) can allow plurality LED (36*a*) light beam passing through and offer desire illumination to be seen from front areas (30*a*), openings or cutouts, windows, shape hole(s) (33*c*) (33*d*) (33*e*) (33*e*) (33*f*).

The More than one LED light source (36*a*) emit light to top reflective area (32*a*) of character $2^{nd}$ optic-element (30*a*) which may have art, painting, color, printing, character shape, design. So, the up-grade for parent FIG. 17A is big improvement with different $1^{st}$ and $2^{nd}$ optic-element construction and light source arrangement and the installation of $2^{nd}$ optic-element to the base.

From FIGS. 17A, 17B show the up-grade of parent filed case "more than one optic-element(s) for LED night light as parent filed case (#Q-2007)".

The current invention has big improvement for update technical and skill as below listed (2) exemplary discussion;

FIG. 17A is parent filed case one of drawing and FIG. 17B show current invention with upgrade Plurality of LEDs (36*a*) and improvement or alternative $1^{st}$ (33*a*) and $2^{nd}$ optic-element(s) (30*a*) for 17-1: A multiple function LED night light, comprising;

At least one LED (36*a*);

At least a first optic-element (33*a*) and a second optic-element (30*a*) for transmitting light beam from said LED (36*a*)

Wherein the 1st optic-element (33*a*) is a low-height dome lens, or a flat lens, or a refractive optic-lens fit within the night light base (2*ba*) top opening (38*a*) to cause the lower position at least one colorful LED(s) (36*a*) or LED set(s) light-beam travel or refracted through and emit to the $2^{nd}$ optic-element (30*a*).

At least one of $2^{nd}$ optic-element (30*a*) has geometric shape at least including cartoon or character shape with preferred light-transmitting capability with or without shape-hole(s) (33*f*), opening(s) (33*e*), cut-out(s) (33*c*) to show the different light color, brightness, effects while the LED light beam emit out from $1^{st}$ optic-element (33*a*) and go through $2^{nd}$ optic-element (30*a*) different area(s);

Wherein $2^{nd}$ optic-element (30*a*) different area(s) including (1) opening(s) (33*c*) (33*d*) (33*e*) (3M) area, (2) opaque or low light transmitting capability area(s) (32*a*), (3) high light transmitting capability (30*a*), and At least one of additional switch (2*bd*) to get at least one of desired LED light effects or function including (1) select or freeze preferred color, (2) select the light show including fade-in & fade-out, chasing, sequential or other light show available from market, (3) function selection between motion (33*k*) sensor or none motion sensor activate the light function(s), (4) select the brightness, (5) other setting, adjustable, selection, changing of LED related functions.

17-2: A multiple function LED night light, comprising;

At least one of LEDs (36*a*) built-in the night light housing (2*ba*) incorporate circuit changing house AC to desire DC and IC for preferred LED illumination(s), and At least one of motion (33*k*) or radar (33*n*) and photo (33*m*) sensor system or trigger-device (2*bd*) incorporate with IC (34*b*); to turn on and turn off the said LED(s) (36*a*) for pre-determined LED light effects that at least including one or more of (i) area illumination (33*j*), (ii) color changing, (iii) color selection (2*bd*), (iv) light show change, (v) motion (33*k*) or non-motion function selection, (vi) brightness adjustable, (vii) wake-up or sleep LED light function (33*p*), (viii) power failure light (35*a*), (ix) flashlight (35*a*), (x) emergency light (35*a*); while LED light has AC power or lose AC power, and, and At least one of addition function is USB charging-circuit and USB-port(s) (34*c*) installed within the LED night light housing to cause the LED to illuminate and charge other be-charged products.

17-3: A multiple function LED night light, comprising;

At least one of LEDs (36*a*) built-in the night light housing (2*ba*) incorporate circuit (34*a*) changing house AC to desire DC and IC for preferred LED illumination(s) (35*a*) (33*j*) (33*p*), and At least one of photo sensor (33*m*) or trigger-device (2*bd*) incorporate with IC (34*b*); to turn on and turn off the said at least one LED(s) (36*a*) for pre-determined LED light effects including at least one or more of illumination (35*a*) (33*j*) (33*p*) (i) for area (33*j*), (ii) with color changing function (33*j*), (iii) with color selection, (iv) with changeable light show, (v) with photo sensor (33*m*) or non-photo sensor function selection, (vi) with brightness adjustable, (vii) with wake-up or sleep LED light function (33*p*), (viii) for power failure light (35*a*), (ix) flashlight (35*a*), emergency light (35*a*); while LED light has AC power or lose AC power, and At least addition function is at least one switch (2*bd*) built-in housing to allow people to make selection of preferred light show, light performance, light color, functions, brightness.

Figure 18:
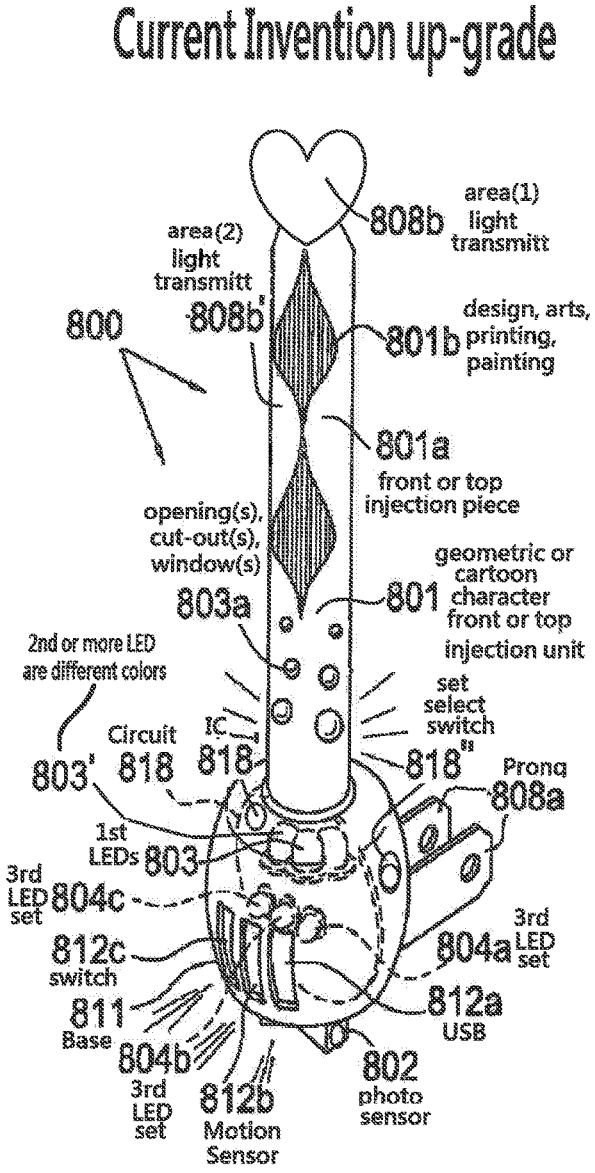
Figure 18A:
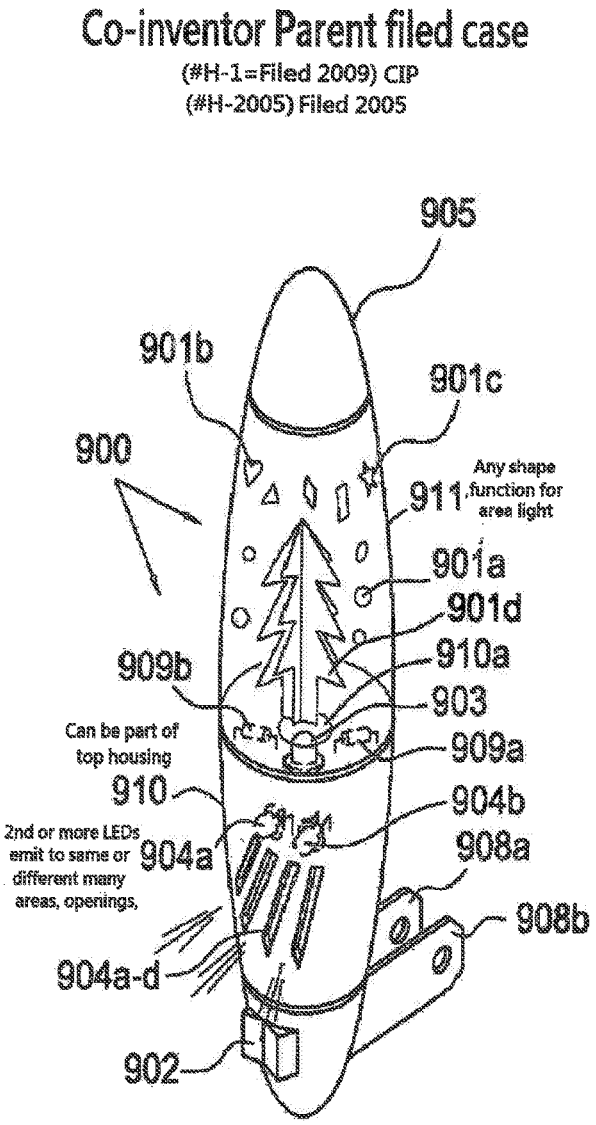

FIG. 18A show the parent filed case (#H-05) which is CIP of (#H-05) U.S. Pat. No. 7,455,444

FIG. 18 show the current invention has big improvement for update technical and skill as below listed (3) exemplary discussion;

18-1: A multiple function LED night light, comprising;

At least two LED light source sets (803) (803') (804*a*) (804*b*) (804*c*) including first (803) and second (803') light sources light beam emit to different locations (808*b*) (808*b'*) (803*a*) selected from the group consisting of openings (803*a*), windows (803*a*), holes (803*a*), cut-outs (803*a*), and light-transmitting areas (808*b*) (808*b'*) of LED light housing (801).

Wherein the first LED light source (803) set supplies the light beam to LED light fixed, detachable, changeable, replaceable light-transmitting areas (808*b*) selected from the group consisting of a lens (6*c*) (7*c*) (30*a*), optic-lens (8*f*) (30*a*), front cover (10*b*) (30*a*), solid plastic piece (40) (400), plastic injection unit(s) (6*c*) (7*c*) (30*a*) (10*b*) (30*a*), and cartoon character shape cover (not shown) with or without the decorative design (182*e*), arts (801*b*), painting (182*e*), printing (182*e*), colors injection or inject with colors, to provide expected light effects, and Wherein the second LED light source (803') set supplies light beams or illumination to the viewer through said openings (803*a*), windows (803*a*), holes (803*a*), cut-outs (803*a*) and the said light-transmitting area(s) (808*b'*) where is different area for first light beam emit to.

18-2: A multiple function LED night light (800), comprising;

At least two LED light source sets (803) (803') (804*a*) (804*b*) (804*c*) installed within a housing (811), Wherein said two of LED light source sets (803) (803') include first (803) and second (803') light set, both are LEDs light sources.

The improvement wherein;

The first (803) and second (803') LED light source set emit preferred color(s) light beam to viewers while the prong (808*a*) connect to AC house power source.

The LED light further comprising light-transmitting parts (808*b*) (808*b'*) of housing to make said night light have a valuable appearance and selected from the group consisting of any combination of a lens (6*c*) (7*c*) (30*a*), optic-lens (8*f*) (30*a*), front cover (10*b*) (30*a*), solid plastic piece (40) (400), plastic injection unit(s) (6*c*) (7*c*) (30*a*) (10*b*) (30*a*), and cartoon character shape cover (not shown) a solid plastic injection piece (40) (400), a texture lens (801*b*), an injection cover (8*f*) (30*a*), an injection cartoon character cover (not shown) with or without preferred design (182*e*), arts (801*b*), painting (182*e*), printing (182*e*), injection-color or inject with colors to provide expected light effects, and Wherein, the First LED light source set (803) emit single color light beam and the second LED light source set (803') emit the multiple color light beam to make desired light show including at least one of desired color-changing, color mixing, multiple colors, sequential flashing, fade-in and fade-out, continuous changing colors, or other LED light effects while incorporate with IC (818), and At least one of additional function is at least one switch (818") or trigger-combination including desired combination of photo, motion, moving, radar sensor(s) to get at least one of desired light effects or function including (1) select or freeze preferred color, (2) select the light show including fade-in & fade-out, chasing, sequential or other light show available from market, (3) function selection between motion sensor or none motion sensor activate the light function(s), (4) select the brightness, (5) other setting, adjustable, selection, changing of LED related functions.

For easily to see the support each claim hereafter supply the quickly index to review with marking number of each additional function, circuit, device basing the current invention figure(s) and text.

the additional function or device is selected from the group consisting of:

(i) air freshener, fragrance refill piece, liquid or wax fragrance or de-order piece as [FIG. 3 (24)]

(ii) adaptor/USB-port(s)/Outlet(s)/Audio receiving port(s)/memory-kits receiving slot(s) device as [FIG. 1 (20), FIG. 2 (20*a*) (22*b*) (22*c*), FIG. 7 (7M), FIG. 8 (8*h*) (8*i*), FIG. 9 (9*d*,9*e*,9*f*), FIG. 10 (10*d*) (10*e*)], (iii) sonic repelled/mouse repelled/mosquito high-voltage shock or terminator, bug repelled device, [FIG. 7 (6K)], [FIG. 12 (803)], (iv) USB charging or be-charging circuit as [FIGS. (22*a*) (22*b*) (8*h*) (8*i*) (10*e*)], (v) frequency/wireless transmitting and/or receiving/bluetooth/Z-way/ZigBee/IR/RF remote control/wi-fi/router/APP download software/internet/3.4.5G network device [FIG. 7 (7*h*) (7*i*)], (vi) Second or power fail or emergency light or other 2nd light device as [FIG. 5 LEDs (60) (70), FIG. 4 LED (01), FIG. 9 power fail/emergency LED light source (9*i*) (9*j*)], (vii) USB port for input power for internal battery or for output for charging other be-charge device with Micro-USB, Type A, Type C or preferred USB ports [FIG. 2 (22*a*) (22*b*)], (viii) electric message device as [FIG. 7 (7*h*) (7*i*) for wireless transmitter and/or receiver], (ix) timer/temperature/timepiece/device [FIG. 10 (10*e*)], (x) power-bank having USB port and rechargeable battery device [FIG. 7 (7*e*) (7M)], [FIG. 9 (9K) (9*i*) (9*j*) (9*h*)] [FIG. 6 (6*j*)]

(xi) surge protection/electric short circuit protection device [FIG. 10 (10*f*), FIG. 7 (6*g*)], [FIG. 10 (10*f*), FIG. 7 (6*g*)], (xii) motion/photo/moving/radar detector or sound activated/others sensor (28) (6*i*) (7*j*) (9*g*) or sensor+screen comparison-system, mobile device screen (not shown)

(xiii) base device for installation on an existing lamp socket as [FIG. 13 (13') or FIG. 13A (13")], (xiv) emergency/power fail light, and rechargeable battery device as [FIG. 9 (9K) (9*i*) (9*j*) (9*h*)] [FIG. 6 (6*j*)], or (xv) wire-arrangement for LED night light have USB-port as [FIG. 3 (23), FIG. 8 (8*j*) slot, groove, ditch]

(xvi) Audio/sound/music device by pre-record or memory-units or blue-tooth or wi-fi connection as [FIG. 3 (24)]

(xvii) a camera and/or a wireless communication device the data storage device is a memory unit, SD card, micro SD card, to enable a photo, video, or sound to be saved into the data storage device and/or wireless transmitted or communicated to another electric device as [FIG. 7 (7N)].

(xviii) A circuit additional to add into the LED light to trigger, select, set, program, adjust, change, the on/off, color(s), brightness, light show, function(s), LED light source(s) including at least one or desired combination select from (1) IC (34*b*), (2) motion sensor (33*k*), (3) moving sensor, (4) radar sensor (176*d*), (4) photo sensor (7*j*), (5) conductive switch (182*d*), (6) push on/off, toggle switch (182*d*), slide switch (182*d*) or other mechanical or electric or electronic switch (180), (7) IR or RF remote control (7*i*), (8) blue tooth (7*i*), Zig-Bee (7*i*), Z-way (7*i*), wi-fi (7*h*) or other wireless controller (7*i*) (7*h*), (9) sound (7*n*) (24), audio (7*n*) (24), pressure, flood sensor or other electric sensor(s) (6*i*), (10) other controller by wired or wireless (7*i*) (7*h*).

(xix) A multiple function LED night light, the said additional function or device is at least one of (1) a camera (7*n*) and/or a wireless communication device (7*a*) (7*h*) (7*i*), or (2) the data storage device selected from (2-1) a memory unit (7M), (2-2) SD card (7M), micro SD card (7M) to enable a photo, video, or sound to be saved into the data storage or wireless cloud device (7M), and/or (3) wireless transmitted (7*h*) (7*i*) or communicated to another electric device (xx) A multiple function LED night light as, the said additional function or device is at least one of USB charger and/or be-charged device (7M), or Power-Bank device (7K); has built-in preferred USB-ports (7M) select from Type A (22) (22*a*), C (23), Mini (22*b*) or Micro-USB (22*b*) or market available type.

(xxi)

(xxii) A multiple function LED night light, the said additional function or device or circuit is at least one of female receiving-port(s) (20) (22)(22*a*) (22*b*) (7M) (10*d*) (10*e*)(9*d*)(9*e*)(9*f*) (8*h*) (8*i*) (168*b*) (168*c*) (169*b*) (169*c*) (170*b*) (170*c*) (171*b*) (171*c*) (172*b*) (172*c*) (173*b*) (173*c*) (174*b*) (174*c*) (175*b*) (175*c*) (176*b*) (176*c*) (177*b*) (177*c*) (178*b*) (178*c*) (179*b*) (179*c*) (180*b*) (181*b*) (182*b*) (182*c*) (183*b*)(183*c*) (184*b*) (184*c*) (185*b*) (185*c*) to receive a male connector or plug to get and/or supply power, and/or deliver an electric signal at least one of AC or DC current or power (not data), from the multiple function LED night light.

From above discussed and mentioned of preferred embodiments to show the scope of the current invention, it is appreciated that any alternative or equivalent functions of design still within the scope of the invention but not limited to all above discussion and mentioned details. The alternative or equivalent arrangement, process, installation or the like design, changes from the current invention still fall within the scope of the current invention.

I claim:

1. An LED night light including:

at least one LED arranged to serve as a light source for providing illumination, the at least one LED including at least one of (1) a white color and (2) a multiple color chip or dice built-in the at least one LED rather than a plurality of separate colored LEDs; and at least one circuit to connect with at least one prong to deliver electricity from a home AC wall power source to the at least one LED and turn on and off the at least one LED by a photo sensor or manual switch for white color light illumination, wherein the at least one prong extends from a night light geometric housing or a prong circuit base to accommodate the at least one LED, wherein the night light has at least one first optics piece and/or at least one second optics piece to eliminate or change a bright spot caused by the at least one LED, and wherein:

(a) the first optics piece is at least one of:

(a-1) at least one of a tube having a top end, a cone having a sharp tip, and a planar or dome piece, fitted within the prong circuit base and located on top or in front of the at least one LED;

(a-2) a partial cylindrical piece fitted with the prong circuit base or geometric housing and located on one side or in front of the at least one LED;

(a-3) at least one curved or flat reflective piece which does not transmit light, an annular piece having multiple levels or diameters, or a dome-shaped optics lens or piece; having at least one of reflective and refractive properties, and fitted within an inner night light housing and located on top or in front of the at least one LED; and (a-4) inner or outer non-light-transmitting reflective surfaces or walls of the prong circuit base or night light housing;

(b) the second optics piece is included in or fitted to the prong circuit base or the housing of the night light, and is at least one of:

(b-1) a geometrically shaped unit having a treatment, whitening, at least one opening, bubbles, and/or texturing;

(b-2) one of a cartoon mask, unit, or body; having at least one light transmitting area or hole;

(b-3) a unit that lacks at least one of a rear, top, or side wall; and (b-4) an outer surface of a front cover or a front housing, and wherein light beams from the at least one LED:

(i) pass through the first optics piece and are shown on at least one area of the second optics piece;

(ii) are emitted to at least one of (ii-1) the inner non-light-transmitting reflective surfaces or walls, (ii-2) inner walls of the night light or prong unit, and (ii-3) under the second optics piece, an inner isolated compartment without any electrical parts; for reflection and refraction multiple times to exhibit light without bright spots on the second optics piece; and/or (iii) illuminate a home wall.

2. An LED night light as claimed in claim 1, further having an additional function provided by at least one receiving port including at least one of an adaptor port, a USB port, an outlet, an audio receiving port, or a memory kit receiving slot; to deliver current or electric signals or digital data.

3. An LED night light as claimed in claim 1, further having an additional function provided by at least one of an air freshener, a fragrance refillable piece, a liquid or wax fragrance, or a deodorizer device.

4. An LED night light as claimed in claim 1, further having an additional function provided by at least one of a sonic repellant, mouse repellant, mosquito high-voltage shocker or terminator, and bug repellant device.

5. An LED night light as claimed in claim 1, further having an additional function provided by at least one of a USB charging or recharging circuit or device to deliver power or direct current.

6. An LED night light as claimed in claim 1, further having an additional function provided by at least one of a (i) wireless transmitting and/or receiving device, (ii) IR or RF remote control, (iii) wi-fi system, (iv) wi-fi extender, (v) router, (vi) APP download software, (vii) internet device, and (viii) 3/4/5G or more advanced network device.

7. An LED night light as claimed in claim 1, further having an additional function provided by at least one second or more LED light source, each having one of:

(i) a different position or location or orientation relative to said at least one LED, or (ii) a light-emitting direction that is different than a light-emitting direction of said at least one LED.

8. An LED night light as claimed in claim 1, further having an additional function provided by at least one second or more LED light source for a power fail light, an emergency light, or a flashlight, when the LED light has lost AC power.

9. An LED night light as claimed in claim 1, further having an additional function provided by a second or more LED light source including at least one single white color or multiple color chip or dice built inside one LED and incorporated with at least one of an integrated circuit, or select-switch to operate one or more of the following light functions: (i) color changing, (ii) color selection, (iii) chasing, (iv) sequential, (v) fade-in and fade-out, or (vi) other light show functions or effects.

10. An LED night light as claimed in claim 1, further having an additional function provided by at least one second or more LED light source for providing at least one second LED function or performance other than static or steady-on illumination before turning off the light by at least one of a switch, photo sensor, and motion sensor.

11. An LED night light as claimed in claim 1, further having an additional function provided by at least one second or more LED light source to emit to a contour or edge of the night light to form a surrounding light shown within an inner space of the night light or an outside wall of the night light.

12. An LED night light as claimed in claim 1, further having an additional function provided by at least one second or more LED light source to emit light beams to night light inside space or parts which are at least one of a (ii) wall, (ii) inner isolating or divider wall or parts, (ii) first or second optic lens or protective lens, and (ii) a housing; to reflect and refract multiple times to get substantially even brightness.

13. An LED night light as claimed in claim 1, further having an additional function provided by at least one USB port for (1) input of power to an internal battery or circuit, or (2) output of power for charging another device incorporated with a USB wire.

14. An LED night light as claimed in claim 1, further having an additional function provided by at least one electric message device including one audio, video, sound, or digital data device; configured to record into memory, or connect via Bluetooth, Wi-Fi, or a wireless system, to play music or sound.

15. An LED night light as claimed in claim 1, further having an additional function provided by at least one of (i) a timer, (ii) a temperature device, (iii) a timepiece, or (iv) a weather related device.

16. An LED night light as claimed in claim 1, further having an additional function provided by at least one power-bank having input and output USB ports, and a built-in rechargeable battery.

17. An LED night light as claimed in claim 1, further having an additional function provided by at least one safety device including at least one of (a) a surge protection device, (b) an electric short circuit protection device, (c) an over-charge protection device, and (d) an over-heat protection device, with or without a restart or reset switch; wherein the surge protection device has circuitry to prevent a high voltage electric signal from getting into and damaging the multiple function LED night light.

18. An LED night light as claimed in claim 1, further having an additional function provided by at least one sensor including at least one of a motion, photo, moving, radar, sound, screen, and screen comparing sensor.

19. An LED night light as claimed in claim 1, further having an additional function provided by at least one base device for installation on a screw-in, pin, or snap-twist LED bulb or bulb receiving socket.

20. An LED night light as claimed in claim 1, further having an additional function provided by at least one of an emergency light, power fail light, or flashlight; with an on/off/auto select-switch and a rechargeable battery device.

21. An LED night light as claimed in claim 1, further having an additional function provided by at least one built-in or added-on wire-arrangement having at least one of (a) a groove, (b) a ditch, (c) walls, (d) recess gaps, (e) a recess shaped holder, (f) a cut-out holder, (g) a foldable frame or pole, (h) a cut-out on the housing, and (i) walls to hold USB-wires, or USB-wire plug.

22. An LED night light as claimed in claim 1, further having an additional function provided by at least one AC outlet unit to deliver or supply alternating current through at least one AC outlet to another product.

23. An LED night light as claimed in claim 1, wherein the first optics is a partial cylinder optic-lens that provides an alternative light beam traveling path and is positioned with respect to a prong circuit base on one side of the at least one LED to reflect and refract multiple times within the prong circuit base to emit light without bright spots, and to emit light beams to a second optics piece which is at least one of a cartoon, character, licensed entity, mask, and body having at least one light transmitting area, opening, cutout, painting, printing, and art.

24. An LED night light as claimed in claim 1, wherein an alternative light beam traveling path is provided by at least one of a first optic-lens or projective lens in a tube or cone with a reflective top or sharp tip to cause at least one LED light beam to travel back and forth and be reflected and/or refracted multiple times and then emitted to second lens or housing, wherein the first optics lens is not a bulb shade unit.

25. An LED night light as claimed in claim 1, wherein an alternative light beam traveling path is provided by at least one of a first optic-lens or refractive lens having a flat shape in front of at least one LED to allow an LED light beam to pass through and be emitted to a second (i) optic-element, (ii) optic-lens, (iii) protective lens, (iv) housing areas, or (v) surface; having a preferred color, refractive properties, or reflective properties to cause the LED light beam to travel within the first and/or second optic-element, optic-lens, lens, or housing for a predetermined light performance.

26. An LED night light as claimed in claim 1, wherein an alternative structure for the second optics piece is provided by at least one of a (i) second optic-lens, (ii) protective lens, and (iii) housing; having a geometric shape; with at least one of preferred art, design, opening, cutout, painting, and printing; and said second optics-lens lacks a rear wall so that lights exiting from the first optics-lens are emitted to a home wall.

27. An LED night light as claimed in claim 1, further having an additional function provided by (A) at least one of a wired or wireless circuit or controller to trigger, select, set, program, adjust, or change at least one of an on/off, color, brightness, and light show function of the LED night light or at least one LED light source, or (B) at least one part selected from: (1) an IC, (2) a motion sensor, (3) a moving sensor, (4) a radar sensor, (4) a photo sensor, (5) a conductive switch, (6) a push on/off, toggle, slide or other mechanical or electric or electronic switch, (7) an IR or RF remote control, (8) a wireless controller, (9) a sound, audio, pressure, flood or other electric sensor, and (10) another wired or wireless controller.

28. An LED night light as claimed in claim 1, further having an additional function provided by at least one of:

(1) a camera and/or a wireless communication device, or (2) a data storage device including at least one of (2-1) a memory unit, (2-2) an SD card or micro SD card to enable a photo, video, or sound to be saved into the data storage device, and (3) wireless transmission or communication to another electric device.

29. An LED night light as claimed in claim 1, further having an additional function provided by at least one of a USB charger and a wireless charger having built-in USB-ports and/or a wireless charging coil to charge other products.

30. An LED night light as claimed in claim 1, further having an additional function provided by at least one female receiving port to receive a male connector or plug to (1) get and/or supply power, and/or (2) deliver an integrated circuit electric signal, without data.

31. An LED night light as claimed in claim 1, wherein the LED includes a single-color LED or at least one multiple color dice or chip built-in one LED.

32. An LED night light as claimed in claim 1, wherein the LED night light has at least one of:

(1) an LED trigger-system, (2) a motion-and-photo sensor, (3) a power-failure circuit to offer a power-fail or emergency light with an on-off-auto function switch for said emergency or power-fail light while power is shutdown or the night light is unplugged.

33. A multiple function LED night light, comprising;

at least two LED light sources or sets, wherein said two LED light sources or sets are first and second lights or sets installed within a housing, wherein:

the housing has at least one of:

(1) a solid plastic injection piece or lens, (2) a textured lens, (3) an injection molded cover, (4) an injection molded cartoon character unit, mask, or body, and (5) cover with preferred art, design, painting, printing, and/or injection-color, the first LED light source set emits the white light beams and the second LED light source set emits the single or multiple color light beams, and the respective light beams are emitted out from different locations of the LED night light; the LED night light including an integrated circuit (IC) to make at least one of:

(1) light functions that are in addition to white light illumination by a photo sensor, and (2) color-changing, color-selection, color-mixing, or multiple color light effects, and the LED night light also includes at least one of (A) a switch and (B) a second sensor that is at least one of a power fail, motion, and radar sensor in addition to the photo sensor to get at least one additional function selected from the group consisting of:

(1) selection of an auto color changing function or a function of freezing a preferred color, (2) selection of a light show function, (3) function selection between motion sensing and (a) no motion sensing or (b) dusk-to-dawn activation of at least one light function, (4) brightness adjustment or selection of low or high brightness, (5) setting LED flashlight functions by a manual on/auto/off switch, (6) selection of one or more power fail or emergency light or flashlight functions while AC power is lost.

34. A multiple function LED night light, comprising:

at least one LED;

at least a first optic-element and a second optic-element for transmitting a light beam from said LED, wherein the first optic-element is a partial cylinder or curved optic-lens that fits within a night light prong circuit unit and is located on a side of the at least one LED, wherein the prong circuit unit has a side opening through which passes at least one light beam from at least one LED set or a plurality of different color dice or chips inside the at least one LED, wherein the light beams are emitted to an inner surface of (1) the first optics element and (2) the prong circuit unit; to cause multiple reflections and refractions within the prong circuit unit and to emit light beams without LED bright spot lights to the second optic-element and, wherein the at least one second optic-element is a cartoon or character shape unit, mask, or body with at least one light-transmitting area, shaped hole, opening, or cut-out to provide a light performance when the light beam exits from the first optic-element and is emitted to the second optic-element, and wherein the LED night light includes at least one additional switch to get at least one additional LED light effect or function including (1) selection of an auto color changing function or a function of freezing a preferred color, (2) selection of a light show function, (3) function selection between motion sensing and (1) no motion sensing or (2) dusk-to-dawn activation of at least one light function, and (4) high-low brightness or sleeping/wakeup light selection.

35. An LED bulb, comprising:

at least one LED that serves as a light source to offer low power consumption illumination and that is installed into a bulb base receiving socket;

wherein at least one LED trigger and circuit are built into the bulb lower-area housing and has electric components to deliver an electric current and signal from a house AC wall power source to turn on the at least one LED for illumination according to predetermined functions, time, brightness, color, and effects, wherein:

(A) the at least one LED is located in the base or a lower portion of the bulb housing and emits light beams to a top of the bulb light-passable housing that has an optical element to convert a narrow, spot-light effect of the at least one LED to a surface-light and/or area light effect;

(B) the optical element is installed on the top area of bulb to enhance visibility of the light beams emitted by the at least one LED; and (C) the at least one LED emits a single color or multiple colors; and wherein the bulb male base fits into bulb receiving socket connected with an AC or DC power source and which is one of (i) a prong-base or (ii) a wired base.

* * * * *